US012698909B2

(12) United States Patent
Shi et al.

(10) Patent No.: US 12,698,909 B2
(45) Date of Patent: Aug. 4, 2026

(54) AUXILIARY HEAT EXCHANGER COIL FOR OUTDOOR SIDE-DISCHARGE UNITS

(71) Applicants: Trane International Inc., Davidson, NC (US); Trane Air Conditioning Systems (China) Co. Ltd., Taicang (CN)

(72) Inventors: Ying Shi, Shanghai (CN); Jeffrey L. Stewart, Whitehouse, TX (US)

(73) Assignee: Trane International Inc., Davidson, NC (US)

( * ) Notice: Subject to any disclaimer, the term of this patent is extended or adjusted under 35 U.S.C. 154(b) by 406 days.

(21) Appl. No.: 18/338,621

(22) Filed: Jun. 21, 2023

(65) Prior Publication Data

US 2024/0353120 A1 Oct. 24, 2024

(30) Foreign Application Priority Data

Apr. 18, 2023 (CN) ..... 202320871998.7

(51) Int. Cl.
*F24F 1/56* (2011.01)
*F24F 1/14* (2011.01)
*F24F 1/38* (2011.01)

(52) U.S. Cl.
CPC ..... *F24F 1/56* (2013.01); *F24F 1/14* (2013.01); *F24F 1/38* (2013.01)

(58) Field of Classification Search
CPC ..... F24F 1/14; F24F 1/16; F24F 1/38; F24F 1/50; F24F 1/56; F24F 1/06; F24F 1/18; F24F 13/20; F24F 2013/205
See application file for complete search history.

(56) References Cited

U.S. PATENT DOCUMENTS

| | | | | |
|---|---|---|---|---|
| 9,605,882 | B2 | 3/2017 | Hancock | |
| 9,759,456 | B2 | 9/2017 | Hancock | |
| 10,119,730 | B2 | 11/2018 | Lin | |
| 10,365,025 | B2 | 7/2019 | Hung | |
| 10,767,891 | B2 | 9/2020 | Bogart | |
| 10,775,054 | B2 | 9/2020 | Bradford et al. | |
| 11,262,112 | B2 | 3/2022 | Karkhanis et al. | |
| 11,397,014 | B2 | 7/2022 | Bhosale et al. | |
| 2010/0011803 | A1* | 1/2010 | Warnecker | F28F 1/022 165/104.34 |
| 2011/0056668 | A1 | 3/2011 | Taras et al. | |

(Continued)

*Primary Examiner* — Len Tran
*Assistant Examiner* — Kamran Tavakoldavani
(74) *Attorney, Agent, or Firm* — Womble Bond Dickinson (US) LLP

(57) ABSTRACT

Examples of the present disclosure relate to systems and methods for incorporating an auxiliary heat exchanger into a refrigerant fluid circuit of a side-discharge outdoor unit of a climate control system, and operating the climate control system in combination with the auxiliary heat exchanger. The auxiliary heat exchanger may be configured to reduce refrigerant fluid temperatures at points in the refrigerant fluid circuit before reaching a primary outdoor heat exchanger of the outdoor unit. In general, available space along the top portion of an outdoor side-discharge unit may be utilized to house the auxiliary heat exchanger. In some examples, a bypass valve may be provided to include or exclude the auxiliary heat exchanger from the refrigerant fluid circuit during operation of the climate control system in various modes.

20 Claims, 11 Drawing Sheets

(56) References Cited

U.S. PATENT DOCUMENTS

| | | | | |
|---|---|---|---|---|
| 2011/0126581 | A1* | 6/2011 | Cho | F25B 40/02 62/507 |
| 2022/0196254 | A1* | 6/2022 | Hayashi | F24F 1/0022 |
| 2022/0235974 | A1 | 7/2022 | Jovet | |
| 2025/0155154 | A1* | 5/2025 | Ishimura | F25B 47/022 |

* cited by examiner

AUXILIARY HEAT EXCHANGER COIL FOR OUTDOOR SIDE-DISCHARGE UNITS

TECHNOLOGICAL FIELD

This application claims priority to Chinese Patent Application No. 202320871998.7, filed Apr. 18, 2023, entitled Auxiliary Heat Exchanger Coil for Outdoor Side-Discharge Units, the content of which is incorporated herein by reference in its entirety.

BACKGROUND

Various climate control systems exist, and several of these systems are able to provide both heating and cooling. These systems use refrigerant fluid circuits to transport thermal energy between components of the system. Each of these designs offer various advantages, and typically provide for conditioning over a given temperature range. A common form of these systems, often referred to as a heat pump, uses a reversible refrigerant fluid circuit that moves thermal energy between two or more heat exchangers to provide heating and/or cooling as desired.

Each of these systems involve multiple different components, many of which work together in an interconnected fashion. Moreover, each of these systems is exposed to different environmental conditions that effect performance and the remaining useful life of components. Systems working in hot and humid environments can struggle with limited cooling capacity leading to strain on the system. Such strains and limitations on systems can be further compounded due to sizing restrictions due to limited installation space. The prevention of such damage to these systems, however, can be challenging.

As a result, there exists an opportunity for adding cooling capacity and reducing system strain for size restricted systems.

BRIEF SUMMARY

The present disclosure relates to systems and methods for incorporating an auxiliary heat exchanger into a climate control system and operating the climate control system in combination with the auxiliary heat exchanger. In general, this disclosure focuses on utilizing an auxiliary heat exchanger with an outdoor unit of a climate control system. The outdoor unit, in some examples, may be an outdoor side-discharge unit and the auxiliary heat exchanger may be disposed along the top of the outdoor side-discharge unit. By placing the auxiliary heat exchanger near the top of the outdoor unit, the interior space may be utilized more fully in order to provide additional cooling capacity and reduce strain on other system components.

The present disclosure thus includes, without limitation, the following examples.

Some example implementations include A side-discharge outdoor unit of a climate control system comprising: an enclosure defining an interior space and an exterior boundary of the side-discharge outdoor unit; a compressor located within the enclosure and configured to circulate a refrigerant fluid within a refrigerant fluid circuit of the climate control system; an L-shaped primary heat exchanger located within the enclosure and coupled to the refrigerant fluid circuit, the L-shaped primary heat exchanger being configured to transfer thermal energy between the refrigerant fluid circuit and an external environment; a plate shaped auxiliary heat exchanger located within the enclosure and coupled to the refrigerant fluid circuit, the plate shaped auxiliary heat exchanger being configured to transfer thermal energy between the refrigerant fluid circuit and the external environment, and an outdoor fan located within the enclosure and configured to provide an airflow from the external environment to contact at least the L-shaped primary heat exchanger and the plate shaped auxiliary heat exchanger, wherein the enclosure includes: a heat exchanger guard defining the exterior boundary for a first section, the first section located along one or more sides of the enclosure, wherein the L-shaped primary heat exchanger is disposed within the interior space along a portion of the first section proximate the heat exchanger guard, a cover plate defining the exterior boundary for a second section and including a plurality of openings, the second section located on a top of the enclosure, wherein the plate shaped auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, and wherein the outdoor fan is aligned axially with the airflow opening, wherein the second section spans between the first section and the third section.

Further example implementations may include A side-discharge outdoor unit of a climate control system comprising: an enclosure defining an interior space and an exterior boundary of the side-discharge outdoor unit; a compressor located within the enclosure and configured to circulate a refrigerant fluid within a refrigerant fluid circuit of the climate control system; a primary heat exchanger located within the enclosure and coupled to the refrigerant fluid circuit, the primary heat exchanger being configured to transfer thermal energy between the refrigerant fluid circuit and an external environment; an auxiliary heat exchanger located within the enclosure and coupled to the refrigerant fluid circuit, wherein the primary heat exchanger and the auxiliary heat exchanger are fluidly arranged in series within the refrigerant fluid circuit and the auxiliary heat exchanger is configured to transfer thermal energy between the refrigerant fluid circuit and the external environment, and an outdoor fan located within the enclosure and configured to provide an airflow from the external environment to contact at least the primary heat exchanger and the auxiliary heat exchanger, wherein the enclosure includes: a heat exchanger guard defining the exterior boundary for a first section, the first section located along one or more sides of the enclosure, wherein the primary heat exchanger is disposed within the interior space along a portion of the first section proximate the heat exchanger guard, a cover plate defining the exterior boundary for a second section and including a plurality of openings and a plurality of angled slats aligned with the plurality of openings, the second section located on a top of the enclosure, wherein the auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, and wherein the outdoor fan is aligned radial with the airflow opening, wherein the second section spans between the first section and the third section.

Further example implementations may include A side-discharge outdoor unit of a climate control system comprising: an enclosure defining an interior space and an exterior boundary of the side-discharge outdoor unit; a compressor located within the enclosure and configured to circulate a refrigerant fluid within a refrigerant fluid circuit of the climate control system; a primary heat exchanger located within the enclosure and coupled to the refrigerant fluid circuit, the primary heat exchanger being configured to transfer thermal energy between the refrigerant fluid circuit and an external environment; an auxiliary heat exchanger located within the enclosure and coupled to the refrigerant fluid circuit, wherein the primary heat exchanger and the auxiliary heat exchanger are fluidly arranged in parallel within the refrigerant fluid circuit and the auxiliary heat exchanger is configured to transfer thermal energy between the refrigerant fluid circuit and the external environment; and an outdoor fan located within the enclosure and configured to provide an airflow from the external environment to contact at least the primary heat exchanger and the auxiliary heat exchanger, wherein the enclosure includes: a heat exchanger guard defining the exterior boundary for a first section, the first section located along one or more sides of the enclosure, wherein the primary heat exchanger is disposed within the interior space along a portion of the first section proximate the heat exchanger guard, a cover plate defining the exterior boundary for a second section and including a plurality of openings and a plurality of angled slats aligned with the plurality of openings, the second section located on a top of the enclosure, wherein the auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, and wherein the outdoor fan is aligned radial with the airflow opening, wherein the second section spans between the first section and the third section.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise.

BRIEF DESCRIPTION OF THE FIGURE(S)

In order to assist the understanding of aspects of the disclosure, reference will now be made to the appended drawings, which are not necessarily drawn to scale. The drawings are provided by way of example to assist in the understanding of aspects of the disclosure, and should not be construed as limiting the disclosure.

FIGS. 1A, 1B, 1C, 1D, and 1E illustrate perspective views of an outdoor side-discharge unit, according to some example implementations of the present disclosure;

FIGS. 2A, 2B, and 2C illustrate schematic diagrams of a refrigerant fluid circuit, according to some example implementations of the present disclosure;

DETAILED DESCRIPTION

Figure 1A:
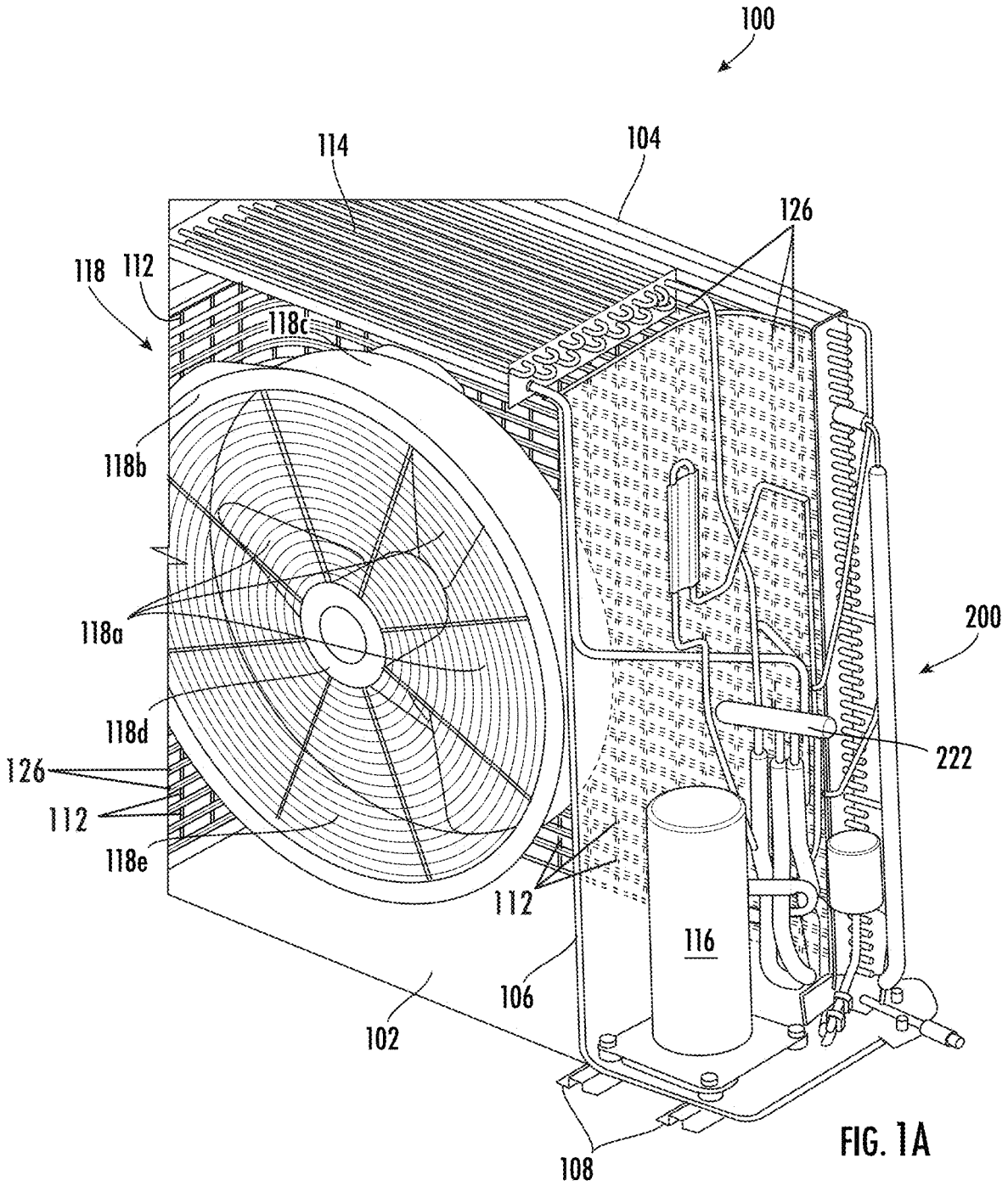

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the embodiments, examples, or implementations set forth herein; rather, these example embodiments, examples, or implementations are provided so that this disclosure will be thorough and complete, and will fully convey the scope of the disclosure to those skilled in the art.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise, or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Like reference numerals refer to like elements throughout.

As used herein, the terms "bottom," "top," "upper," "lower," "upward," "downward," "rightward," "leftward," "interior," "exterior," and/or similar terms are used for ease of explanation and refer generally to the position of certain components or portions of the components of embodiments, examples, or implementations of the described disclosure in the installed configuration (e.g., in an operational configuration). It is understood that such terms are not used in any absolute sense.

As described in further detail below, the present disclosure relates to systems and methods for incorporating an auxiliary heat exchanger into a climate control system and, further, operating the climate control system in combination with the auxiliary heat exchanger. In general, this disclosure focuses on utilizing an auxiliary heat exchanger with an outdoor side-discharge unit of a climate control system.

Additional space near the top of the outdoor side-discharge unit may be utilized to house the auxiliary heat exchanger in order to provide additional capacity and/or efficiency, in cooling modes. The auxiliary heat exchanger, in some examples, may be configured to reduce refrigerant fluid temperature at points along the refrigerant fluid circuit before the refrigerant reaches a primary heat exchanger. Furthermore, in some examples, a bypass valve may be configured to cutoff the auxiliary heat exchanger from the refrigerant fluid circuit to prevent loss of heating capacity in heating modes. Moreover, in some examples, the auxiliary heat exchanger may be configured in parallel with a primary heat exchanger to divert some refrigerant in cooling and/or heating modes, thus acting as an additional circuit for the primary heat exchanger.

An advantage to utilizing an auxiliary heat exchanger, according to some examples of the present disclosure, is that the cooling capacity of a climate control system can be increased for cooling modes without substantially increasing the size or footprint of the outdoor side-discharge unit. Thus, allowing the improved outdoor side-discharge unit to still be utilized in confined spaces, e.g., on balconies. Another advantage, according to some examples of the present disclosure, is that a climate control system utilizing an auxiliary heat exchanger can operate more efficiently in hot and humid environments.

The general structure and layout of various different components of an example outdoor side-discharge unit including an auxiliary heat exchanger will now be described below in more detail with respect to FIGS. 1A-1E. As illustrated, FIGS. 1A-1E depict an example outdoor side-discharge unit 100 from various different perspectives.

Referring now to FIG. 1A, the figure shows a perspective view of the outdoor side-discharge unit 100. As illustrated, the outdoor side-discharge unit 100 may generally comprise an enclosure 104, a compressor 116, a primary outdoor heat exchanger 126, an auxiliary heat exchanger 114, an outdoor fan 118, and at least a portion of the refrigerant fluid circuit 200 along with a switch over valve 222, both of which are described in more detail below with reference to FIGS. 2A-2C. The outdoor side-discharge unit 100 may be configured as part of various different climate control systems, such as climate control system 400 described below with respect to FIG. 4.

As shown in FIG. 1A, the enclosure 104 of the outdoor side-discharge unit 100 may comprise various different components of the outdoor side-discharge unit 100. Each of the components of the enclosure 104 may be configured to define an interior space and an exterior boundary. The interior space is configured to house various different components of the outdoor side-discharge unit 100, e.g., the compressor 116, which circulates refrigerant fluid within the refrigerant fluid circuit 200. The exterior boundary may be configured to at least partially separate the interior space of the outdoor side-discharge unit 100 from the exterior ambient outdoor environment. In some examples, the enclosure 104 may include in whole or in part a housing separate and independent from other components of the outdoor side-discharge unit 100, e.g., a sheet metal cabinet, sheet metal panels, frame support beams, or the like.

Figure 1B:
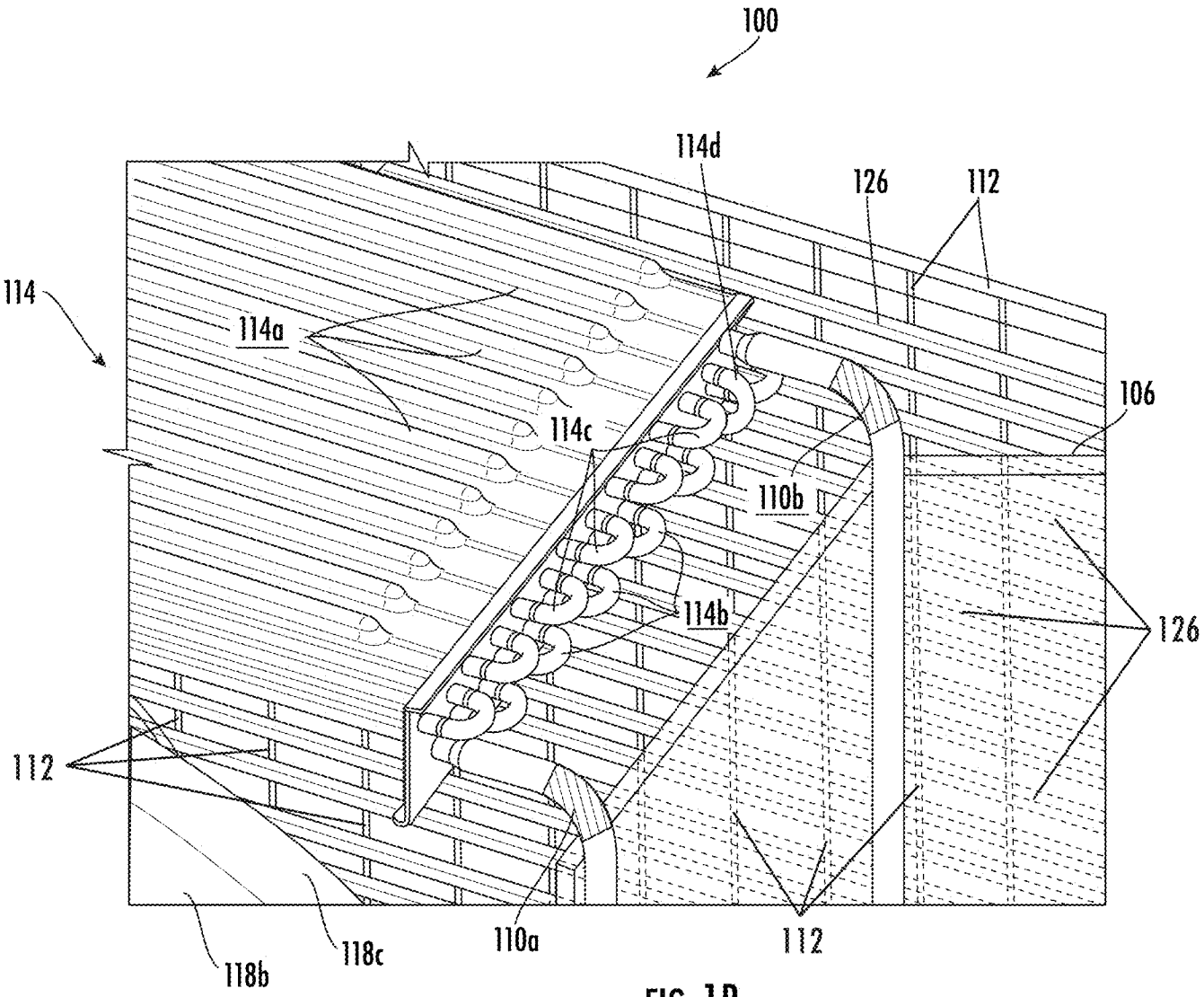
Figure 1C:
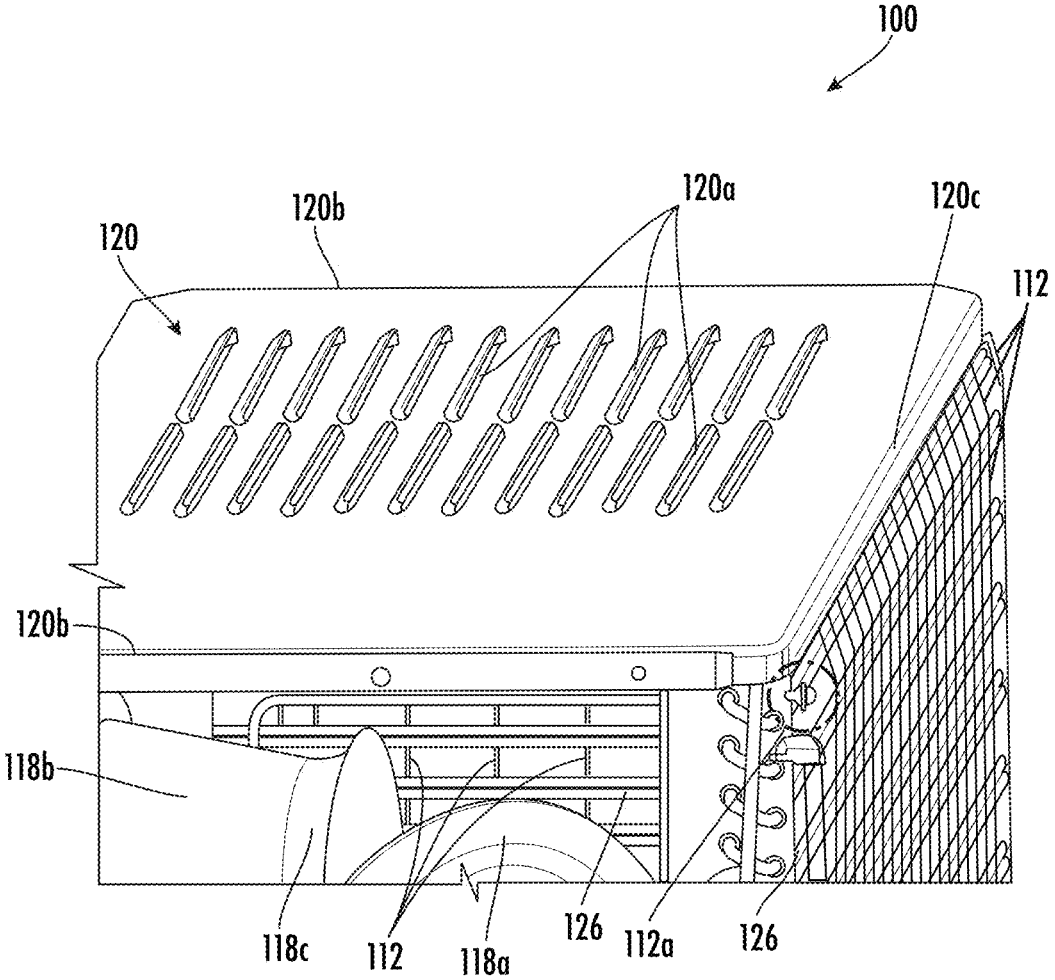

Further, as shown in FIG. 1C, the enclosure 104 of the outdoor side-discharge unit 100 as shown may at least partially include or enclose the primary outdoor heat exchanger 126. In some examples, the primary outdoor heat exchanger may be coupled with a heat exchanger guard 112, via mounting points 112*a*, as described in further detail below. The primary outdoor heat exchanger 126, as illustrated, may be an L-shaped heat exchanger at least partially located within the enclosure 104 and coupled to the refrigerant fluid circuit 200. Moreover, as depicted, the L-shaped heat exchanger may be further configured as a two-row, multi-pass, fin-tube heat exchanger that at least partially wraps around two or more sides of the outdoor side-discharge unit 100 and, as shown, may be supported by a base plate 102 and/or an interior wall 106. It is understood, however, that other types of outdoor heat exchangers may be used as well as other configurations. The heat exchanger guard is also shown in the examples depicted in FIGS. 1A and 1D, located behind the primary heat exchanger 126 and spanning two sides of the enclosure.

Moreover, the enclosure 104 of the outdoor side-discharge unit 100 as shown may at least partially include or enclose the auxiliary heat exchanger 114. In some examples, the auxiliary heat exchanger may be coupled with a cover plate 120 as described in further detail below. The auxiliary heat exchanger 114, as shown in FIG. 1A, may be a plate shaped heat exchanger at least partially located within the enclosure 104. Further, the auxiliary heat exchanger 114 may be coupled to the refrigerant fluid circuit 200. As further illustrated, the auxiliary heat exchanger 114 may be further configured as a two-row, multi-pass, fin-tube heat exchanger that may be at least partially disposed along the top of the outdoor side-discharge unit 100. As described in further detail below, the primary outdoor heat exchanger 126, the auxiliary heat exchanger 114, and/or the like may be configured to transfer thermal energy between the refrigerant fluid circuit 200 and an external environment, e.g., via a medium such as air or with geothermal energy.

Turning to FIG. 1B, as depicted, the auxiliary heat exchanger 114 may include a two-row, multi-pass, fin-tube heat exchanger including at least one continuous pathway for refrigerant flow defined by a plurality of pipes 114*a* coupled via a plurality of U-shaped joints (e.g., a 180-degree elbow joint). The plurality of U-shaped joints may include upper joints 114*c* and lower joints 114*b*, each joint being associated with at least an upper and/or lower layer of the auxiliary heat exchanger 114. The upper and lower layers of the auxiliary heat exchanger 114 may be fluidly coupled by at least a crossover joint 114*d*. The crossover joint 114*d* may be configured to allow refrigerant to flow between the upper and lower layers of the auxiliary heat exchanger 114.

It should be understood that the auxiliary heat exchanger 114 may be configured so that refrigerant flows through internal passages of tubes/pipes in a counter flow configuration. For example, refrigerant may flow through a first pipe of the plurality of pipes 114*a* and into a 180-degree elbow joint (e.g., upper joints 114*c*, lower joints 114*b*, crossover joint 114*d*, etc.) that directs the refrigerant flow into a second pipe of the plurality of pipes 114*a* at substantially a 180-degree angle. Further, the first and second pipes may be generally parallel relative to each other, such that the direction of refrigerant flow in the first pipe flows in a counter direction relative to the direction of refrigerant flow in the second pipe. It should be further understood that the primary outdoor heat exchanger 126 may be configured in the same or similar configuration as the auxiliary heat exchanger 114 as discussed above, or vice versa.

Still with reference to FIG. 1B, the inlet connector 110*a* and the outlet connector 110*b* are configured as 90-degree elbow joints. The inlet connector 110*a* may be configured, as shown, to introduce refrigerant fluid into the auxiliary heat exchanger 114 through an inlet port of the lower layer. Further, the outlet connector 110*b* may be configured, as shown, to receive refrigerant fluid from the auxiliary heat exchanger 114 through an outlet port of the upper layer. In some examples, the auxiliary heat exchanger 114, e.g., in a plate shaped configuration, may include a plurality of heat exchanger circuits fluidly arranged in parallel. In some examples, the inlet connector 110*a* and the outlet connector 110*b* may couple the auxiliary heat exchanger 114 to the refrigerant fluid circuit 200, and/or may further comprise bypass valves, as described in further detail below. FIG. 2B shows a depicted example of an auxiliary heat exchanger that includes a plurality of heat exchanger circuits fluidly arranged in parallel. It is understood, however, that other types of auxiliary heat exchangers may be used as well as other configurations.

Figure 1D:
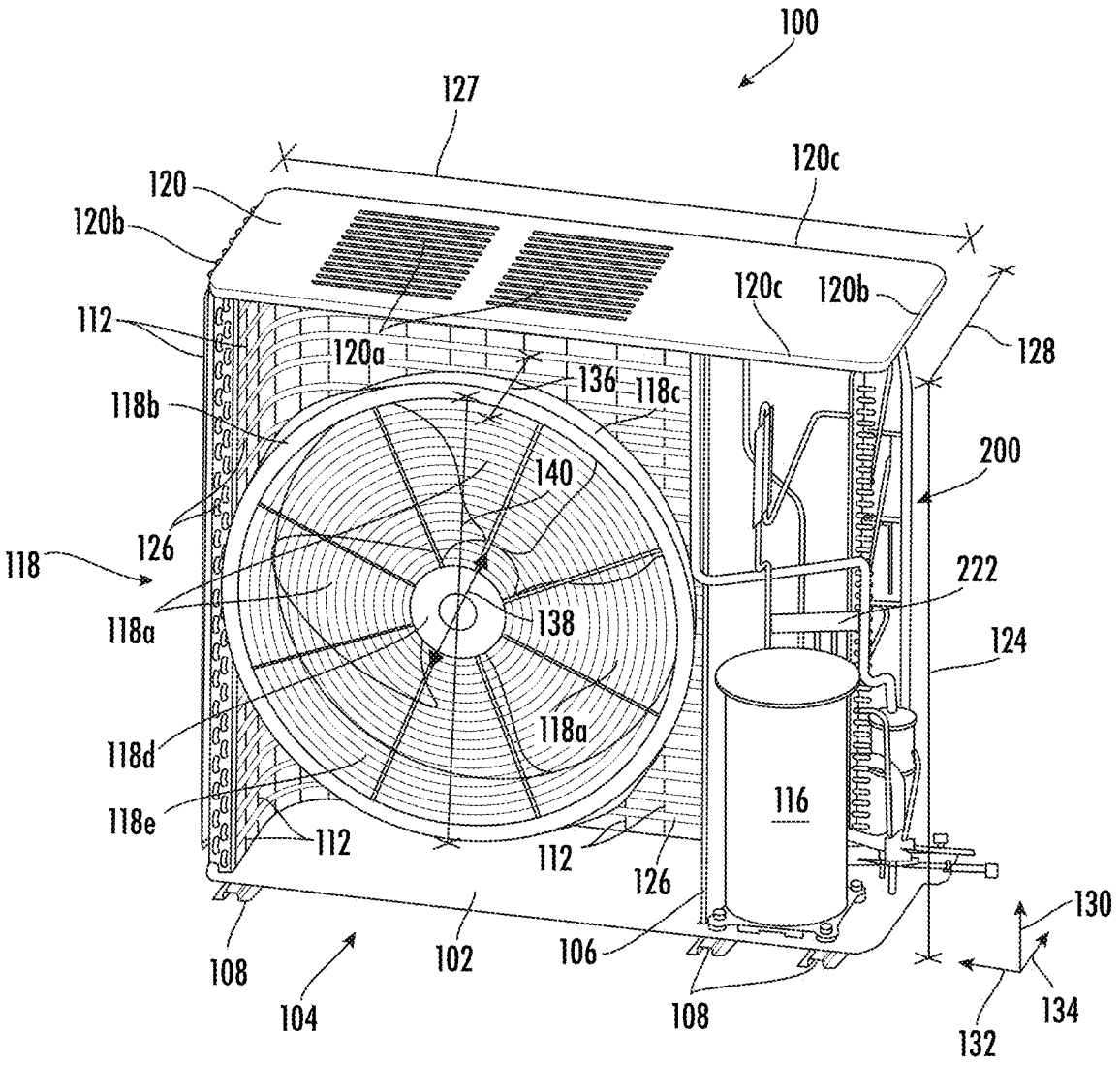

Turning back to FIG. 1A, the outdoor side-discharge unit 100 as shown comprises the outdoor fan 118 which may be located within the interior space defined by the enclosure 104 and configured to provide airflow from the external environment through the interior space in order to contact at least the primary outdoor heat exchanger 126 and the auxiliary heat exchanger 114. As depicted, the outdoor fan 118 may further comprise fan blades 118*a*, a fan cowl 118*b* including a flared end 118*c*, a fan motor 118*d*, and a fan guard 118*e*. In some examples, one or more components may be configured as part of the enclosure 104, e.g., the fan guard 118*e* as shown in FIGS. 1A and 1D. In some examples, the outdoor fan 118 may comprise a plurality of fans, e.g., disposed vertically one over the other, horizontally side-by-side, or some combination thereof.

In addition to the components described above, additional and/or alternative components of the enclosure 104 will now be described below in further detail with reference to FIGS. 1A-1D. It should be understood that the non-limiting examples provided below are described in relation to each other and/or various different side sections of the outdoor side-discharge unit 100, however, these relationships do not preclude alternative configurations of the discussed components and/or the exclusion of some or all of the components from the enclosure 104.

As described above, the enclosure 104 of the outdoor side-discharge unit 100 may include the primary outdoor heat exchanger 126 in an L-shaped configuration as shown in FIG. 1A. Additionally, the primary outdoor heat exchanger 126 may be configured with a heat exchanger guard 112 coupled, via mounting points 112*a*, thereto as shown in FIGS. 1B-1C. In some examples, the primary outdoor heat exchanger 126 and the heat exchanger guard 112 may be coupled such that the primary outdoor heat exchanger 126 may provide structural rigidity for the heat exchanger guard 112 and/or vice versa. As shown in FIG. 1C, the heat exchanger guard 112 may be configured to at least partially define the exterior boundary for a first section of the enclosure 104. Further, the first section may be located along one or more sides of the enclosure 104 of the outdoor side-discharge unit 100.

For example, as shown in FIG. 1C, the heat exchanger guard 112 may define the exterior boundary for the first section along a first side of the outdoor side-discharge unit 100 generally opposite from the fan cowl 118*b* as illustrated. Further, as shown in FIG. 1D the heat exchanger guard 112 may define the exterior boundary for the first section along a second side of the outdoor side-discharge unit 100 generally adjacent to the fan cowl 118*b* as illustrated. Moreover, as further depicted in FIGS. 1C-1D, the primary outdoor heat exchanger 126 in the L-shaped configuration is shown disposed within the interior space along a portion of the first section generally along or proximate to the heat exchanger guard 112. In such examples, the primary outdoor heat exchanger 126 may be wholly within the interior space of the outdoor side-discharge unit 100 while the heat exchanger guard 112 defines the exterior boundary of the outdoor side-discharge unit 100. As shown, the heat exchanger guard 112 includes a heavy wired lattice structure. In the depicted example, the heat exchanger guard 112 is designed to protect the primary outdoor heat exchanger 126 and/or other components of the outdoor side-discharge unit 100 from damage, e.g., hail stone damage, shipping damage, or the like. In some examples, the heat exchanger guard is designed to protect the primary heat exchanger from unwanted contaminants such as leaves and debris. In some examples, the heat exchanger guard includes panel walls with louvers or other openings. Still other structures and components may be used as the heat exchanger guard.

Referring to FIG. 1C, as depicted, the auxiliary heat exchanger 114 may be at least partially enclosed by and/or coupled to a cover plate 120 of the enclosure 104. In some examples, the auxiliary heat exchanger 114 and the cover plate 120 may be coupled such that the auxiliary heat exchanger 114 may provide structural rigidity for the heat exchanger guard 112 and/or vice versa. The cover plate 120 may define a portion of the exterior boundary and/or the interior space along a second section, e.g., the top side, of the outdoor side-discharge unit 100 as shown. The cover plate may further include edges 120*c* along the width of the cover plate and edges 120*b* along the depth of the cover plate. These edges may define features of the discharge unit and/or orient other features as discussed below. The auxiliary heat exchanger 114, as depicted, may be in a plate shaped configuration and disposed under/proximate the cover plate along a portion of the second section within the interior space of the outdoor side-discharge unit 100. In the depicted example, the cover plate 120 may be designed to protect the auxiliary heat exchanger 114 and/or other components of the outdoor side-discharge unit 100 from damage, e.g., hail stone damage, shipping damage, or the like.

As depicted in FIGS. 1C-1D, the cover plate 120 may be configured to include a plurality of openings 120*a* configured to allow for airflow through the outdoor side-discharge unit 100. Various different configurations and other non-limiting examples of the plurality of openings 120*a* will now be described in further detail with respect to FIGS. 1C-1D.

In some examples, the plurality of openings 120*a* may include: louvers, vents, mesh, corrugation, grill/wire guards, holes, slots, angled slats, or the like. For example, each of a plurality of angled slats or louvers may be aligned with each of the plurality of openings 120*a* disposed in the cover plate 120. As shown in FIGS. 1C-1D, the plurality of openings 120*a* includes a plurality of louvers including a slot substantially parallel to an edge of the outdoor side-discharge unit 100, potentially parallel to the edges 120*c* along the width of the outdoor side-discharge unit as shown in FIG. 1C-1D. Further, the plurality of louvers each include a tab defining an angle extending at least partially upward, as shown, from the top surface of the cover plate 120. In some examples, the angle of each tab may define a substantially similar angle (e.g., 45-degrees, 60-degrees, or any other angle) for directing airflow into, or out of, the interior space. Further, the angle of each tab may be configured to generally direct airflow down into the interior space, contacting an exterior surface of the auxiliary heat exchanger 114, and generally toward the outdoor fan 118 of the outdoor side-discharge unit 100.

With specific reference to FIG. 1C, the angle of each tab may be different at different lengths along the depth dimension of the outdoor side-discharge unit 100. For example, tabs generally nearest the heat exchanger guard 112, as shown in FIG. 1C, may be at a substantially 30-degree angle, the tabs generally nearest the fan cowl 118*b* may be at a substantially 60-degree angle, and the tabs therebetween may define a plurality of angles between 30-degrees and 60-degrees. The tabs generally nearest the middle of the outdoor side-discharge unit 100, for example may be at a substantially 45-degree angle halfway between 30-degrees and 60-degrees. It should be further understood that some or all of the plurality of openings 120*a* may define a complementary angle, a supplementary angle, or an angle therebetween with at least a top surface of the cover plate 120. In some examples, the outdoor fan 118 may be configured to push air out through the cover plate 120 and/or the heat exchanger guard 112 instead of pulling air inward as described above.

It should be understood that the outdoor side-discharge unit 100 is shown with at least a removed side section or portion thereof. This side section was removed from the illustration in order to show the configuration of the interior space, e.g., the interior wall 106, and to better illustrate the relative locations of various different components, e.g., a base plate 102, and/or their respective shapes, e.g., the L-shape of the primary outdoor heat exchanger 126. However, it should be further understood that such a side section may be configured as another portion of the enclosure 104 of the outdoor side-discharge unit 100 and will now be described below in further detail with respect to FIG. 1E.

Figure 1E:
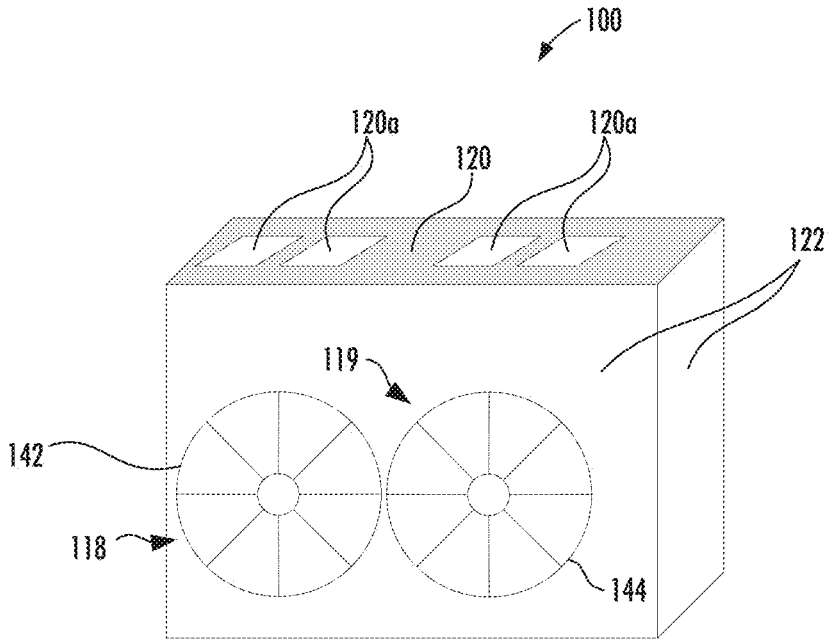

As illustrated in FIG. 1E, the enclosure 104 may include a side panel section defining at least a portion of the exterior boundary of a third section of the outdoor side-discharge unit 100. The third section may be generally adjacent to the first section along one or more sides of the enclosure 104 of the outdoor side-discharge unit 100. Further, the first and third sections may be generally opposite of each other across the defined and enclosed interior space of the outdoor side-discharge unit 100, at least for a portion of either the first and third sections. In some examples, the second section may span between the first section and the third section, e.g., generally perpendicular to each of the first section and the third section and adjacent at least one side of each of the first section and the third section. The side panel section of the enclosure 104 may comprise one or more side panels 122, e.g., sheet metal panels, and each of the side panels 122 may be further coupled to various other components of the enclosure 104, e.g., each other, the cover plate 120, the heat exchanger guard 112, the fan cowl 118*b*, the base plate 102, or the like.

In some examples, at least one of the side panels 122 of the side panel section may include at least an airflow opening as shown, e.g., airflow opening 142, airflow opening 144, or another plurality of openings as described above for openings 120*a*. Moreover, the airflow openings 142 and/or 144 of the side panels 122 may be configured to allow an airflow between the external environment and the interior space, e.g., the airflow provided by the outdoor fan 118. Additionally, in some examples, the outdoor fan 118 may be aligned axially with at least the airflow opening 142 as shown. In some examples, the airflow opening 142 may define a plane that may be perpendicular to a central axis, e.g., central axis 138 depicted in FIG. 1D, defined by the generally cylindrical shape of the fan cowl 118*b*.

In some examples, the outdoor side-discharge unit 100 may include a plurality of outdoor fans including the outdoor fan 118 and an outdoor fan 119 as shown. Further, in such examples, the outdoor side-discharge unit 100 may include the airflow opening 142 and the airflow opening 144 as depicted in FIG. 1E. In such examples, each of the plurality of outdoor fans, e.g., 118 and 119, may each be aligned with a respective air flow opening of the plurality of air flow openings, e.g., the outdoor fan 118 may be aligned axially with the airflow opening 142 and the outdoor fan 119 may be aligned axially with the airflow opening 144. In some examples, the outdoor fan 119 may be the same, or substantially similar to, the auxiliary fan 224 as described below in further detail and illustrated in FIG. 2A. Still in some examples the outdoor fan 119 may be the same, or substantially similar to, any other fan described by the present disclosure, e.g., the outdoor fan 118.

Turning back to FIG. 1D, as shown, the base plate 102 may define at least a portion of the exterior boundary of a fourth section of the outdoor side-discharge unit 100. The fourth section may generally be parallel with the ground and/or another mounting surface of the outdoor side-discharge unit 100. The base plate 102 may be coupled to and provide structural support for various different components of the outdoor side-discharge unit 100 as shown, e.g., the compressor 116, refrigerant fluid circuit 200, the heat exchanger guard 112, the interior wall 106, a combination thereof, or the like. Further, the base plate 102 may be coupled to a plurality of mounting rails 108 that secure the outdoor side-discharge unit 100 to an external structure, e.g., a cantilever beam, balcony, concrete slab, or the like. In some examples, the enclosure 104 and/or the interior wall 106 may define a plurality of interior spaces within the outdoor side-discharge unit 100 as shown in FIGS. 1A-1B and 1D.

In addition to the various different sections, boundaries, and interior spaces described above, the enclosure 104 may further define various different dimensions of the outdoor side-discharge unit 100. Such various different dimensions will now be described in further detail below with reference to the figures and components described above. Example dimensional indicators are discussed with reference to FIG. 1D.

In the depicted example, the outdoor side-discharge unit 100 includes a height dimension 124, a width dimension 127, and a depth dimension 128. In the depicted example, the heat exchanger guard 112 may define a height dimension 124 of the side-discharge outdoor unit, the height dimension being a vertical length of the heat exchanger guard 112 along a vertical axis 130 of the outdoor side-discharge unit 100 in an installed configuration. In some examples, as shown in FIG. 1D, the cover plate 120, the base plate 102, and/or the mounting rails 108 may further define the height dimension 124 along the vertical axis 130 of the outdoor side-discharge unit 100 in addition to the heat exchanger guard 112 as discussed above. In some examples, the height dimension 124 may be equal to or greater than the width dimension 127.

In some examples, the cover plate 120 may further define a width dimension 127 and/or a depth dimension 128 of the outdoor side-discharge unit 100. The width dimension 127 may be a first horizontal length of the cover plate 120 along a first horizontal axis 132 of the outdoor side-discharge unit 100 in an installed configuration, e.g., the distance from a first edge 120*b* to a second edge 120*b* of the exterior boundary each edge defined by a minor side section of the enclosure 104. Moreover, in some examples, the first horizontal axis 132 may be orthogonal to the vertical axis 130 of the outdoor side-discharge unit 100 in an installed configuration. In some examples, the width dimension 127 may be equal to or greater than the depth dimension 128.

In some examples, the depth dimension 128 may be a second horizontal length of the cover plate along a second horizontal axis 134 of the outdoor side-discharge unit 100 in the installed configuration and the second horizontal axis may be orthogonal relative to both the vertical axis 130 and the first horizontal axis 132. For example, the depth dimension 128 may be the distance from a first edge 120*c* to a second edge 120*c* of the exterior boundary each edge defined by a major side section of the enclosure 104.

In some examples, the outdoor fan 118 may include a fan depth dimension 136. In such examples, the fan depth dimension 136 may be an axial length of the outdoor fan 118 along a central axis 138 defined by at least the fan cowl 118*b* of the outdoor fan 118 in the installed configuration. Moreover, the central axis 138 may be normal to a plane defined by a circulation path of an impeller comprising the fan blades 118*a* of the outdoor fan 118. Further, the depth dimension 128 of the outdoor side-discharge unit 100 may be greater than the fan depth dimension by a given depth factor. In some examples, the given depth factor between the two depth dimensions may be equal to or less than a factor of 2, e.g., the depth dimension 128 of the outdoor side-discharge unit 100 may be 1.8 times larger than the fan depth dimension 136 in order to allow the outdoor fan 118 to fit within the interior space of the enclosure 104 in a compact and space efficient manner.

In some examples, the outdoor fan 118 may include a fan height dimension 140. In such examples, the fan height dimension 140 may be a radial length of the outdoor fan 118 along a plane defined by at least the fan cowl 118*b* of the outdoor fan 118 in the installed configuration. Moreover, the plane may be defined as normal to a circulation path of an impeller comprising the fan blades 118*a* of the outdoor fan 118. Further, the height dimension 124 of the outdoor side-discharge unit 100, described above, may be greater than the fan height dimension 140 by a given depth factor. In some examples, the given height factor between the two height dimensions may be equal to or less than a factor of 1.5, e.g., the height dimension 124 of the outdoor side-discharge unit 100 may be 1.25 times larger than the fan height dimension 140 in order to allow the outdoor fan 118 to fit within the interior space of the enclosure 104 in a compact and space efficient manner.

Figure 2A:
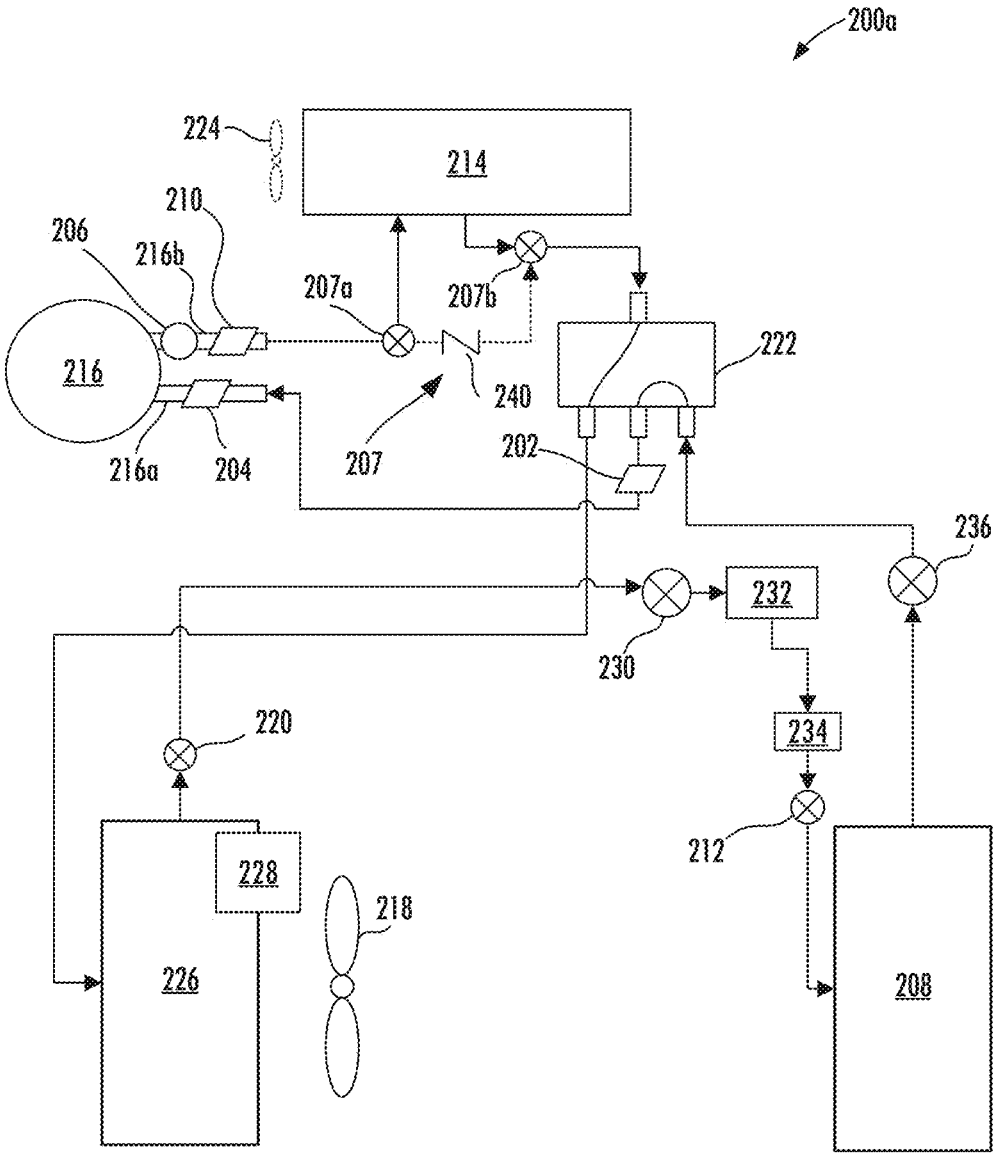
Figure 2B:
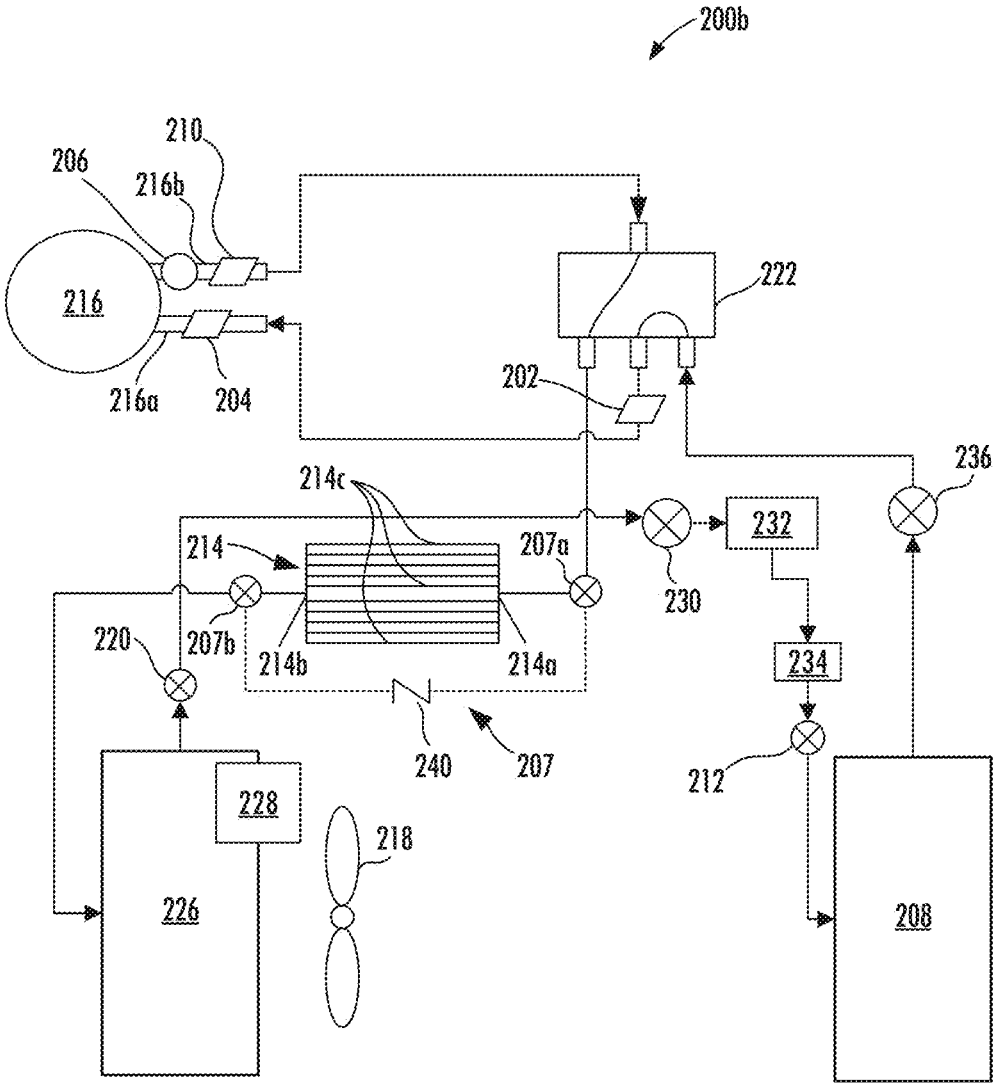
Figure 2C:
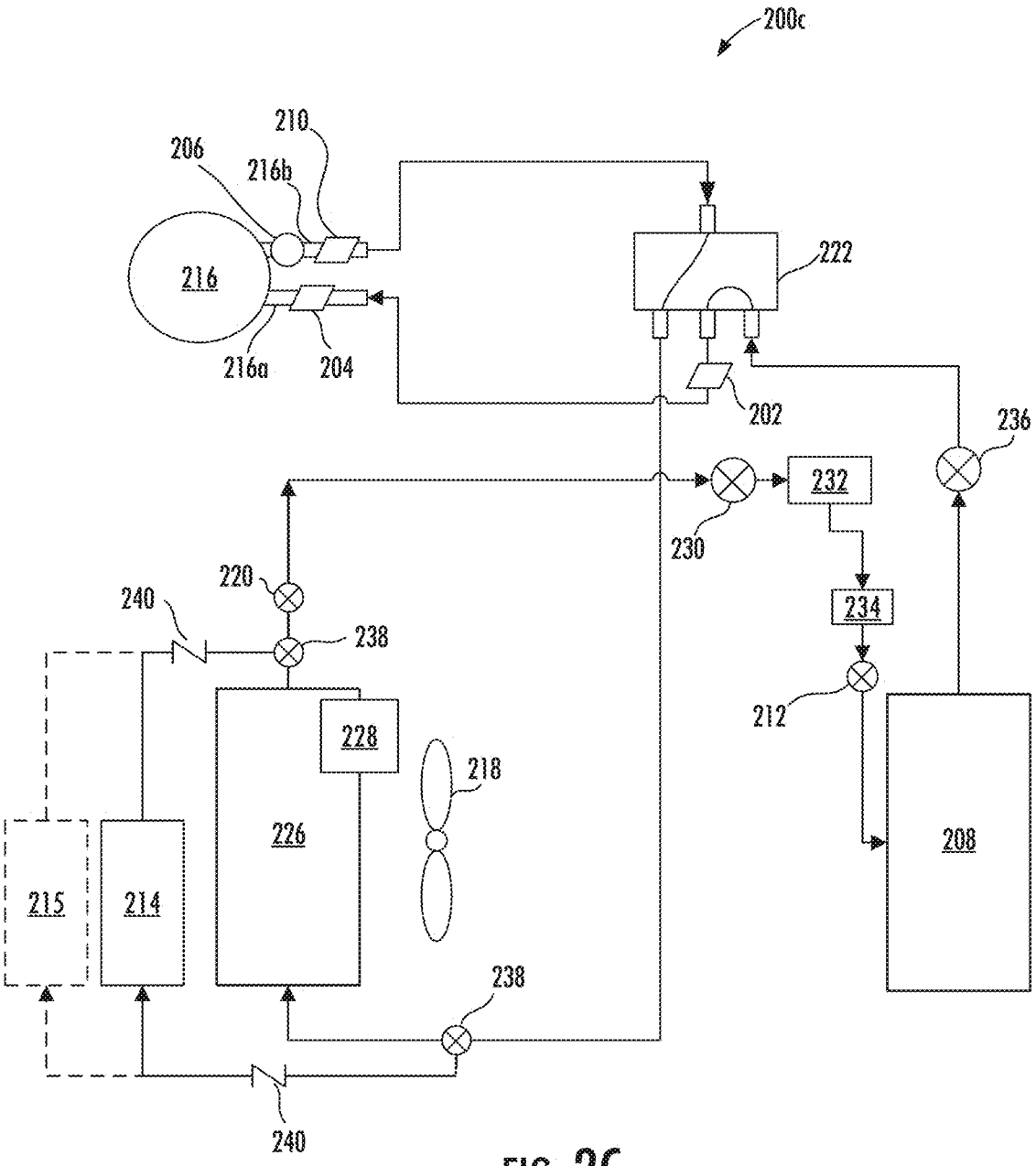

Now that the enclosure 104 of the outdoor side-discharge unit 100 has been generally described above with respect to FIGS. 1A-1D, various additional components for the outdoor side-discharge unit 100 will now be described below in relation to the refrigerant fluid circuit 200 as shown in FIGS. 2A-2C.

FIGS. 2A-2C show schematic diagrams for example refrigerant fluid circuits 200*a*-200*c* which include an auxiliary heat exchanger for an outdoor unit, which may be the same or similar to the outdoor side-discharge unit 100 discussed above. It should also be understood that the refrigerant fluid circuits 200*a*-200*c* may further illustrate additional components (not typically included in the outdoor unit, e.g., the indoor heat exchanger 208) of a climate control system, which may be the same or similar to the climate control system 400 as described in further detail below. The examples depicted in FIGS. 2A-2C of the refrigerant fluid circuits 200*a*-200*c* are configured in a cooling mode but may also be utilized in other modes as described by the present disclosure.

For further context of some example implementations of the present disclosure, refrigerant flow through various different refrigerant fluid circuits 200 utilizing an auxiliary heat exchanger will now be walked through below with reference to some examples depicted in FIGS. 2A-2C. Each of these fluid circuits is shown in a cooling mode configuration, however, in these examples the circuit may be reversed to function in heating mode as discussed in more detail below.

Turning now to refrigerant fluid circuit 200*a* as shown in FIG. 2A, in particular to the switch over valve 222, refrigerant may generally flow from the switch over valve 222 via a pipe configured with a suction sensor 202 to monitor the pressure between the switch over valve 222 and the compressor 216. In some examples, the suction sensor 202 may be one or more sensors described by the present disclosure, e.g., a pressure transducer. The refrigerant may then flow into the compressor 216 via the compressor inlet port 216*a*, the compressor inlet port 216*a* may include another suction sensor 204, e.g., a pressure transducer.

The refrigerant may then flow out of the compressor 216 via the compressor discharge port 216*b*. The refrigerant fluid exiting the compressor 216 may be at substantially higher temperatures and/or pressures than the refrigerant fluid entering the compressor 216. The compressor discharge port 216*b*, e.g., the port, may be configured with a high-pressure switch 206 to cutoff the compressor 216 when pressures higher than a threshold value are detected. The high-pressure switch 206 may be configured with one or more discharge sensors 210, e.g., a pressure transducer, to monitor the pressure and/or temperature of refrigerant fluid between the compressor 216 and the auxiliary heat exchanger 214, or the like. Further, the high-pressure switch 206 may cause operation of the compressor 216 to cease when unsafe operating thresholds are reached or exceeded.

In some instances, the refrigerant fluid exiting the compressor discharge port 216*b* may pass to an optional bypass circuit 207 comprising one or more bypass valves, e.g., bypass valve 207*a*, 207*b*. The bypass valves 207*a* and 207*b* may be configured to selectively include or exclude the auxiliary heat exchanger 214 from the refrigerant fluid circuit based on instructions from a controller. For example, in a heating mode the bypass valve 207*a* may direct the refrigerant fluid to a bypass circuit 207 and into the switch over valve 222 bypassing the auxiliary heat exchanger 214. In the depicted example, the bypass circuit 207 may include at least a check valve 240. In some examples, when the auxiliary heat exchanger is arranged in the configuration shown in FIG. 2A, e.g., between the compressor discharge port 216*b* and the switch over valve 222, it may be advantageous to include the check valve 240 in addition to bypass valves 207*a* and 207*b* to assist in controlling the flow through this circuit. In other examples, other configurations may be used. The process for selectively bypassing an auxiliary heat exchanger is described in more detail below with reference to FIG. 3.

As depicted in FIG. 2A, the auxiliary heat exchanger 214 may be fluidly coupled between the compressor discharge port 216*b* of the compressor 216 and the switch over valve 222, e.g., in order to desuperheat the refrigerant fluid before re-entering the switch over valve 222. It should be understood that in the depicted examples of FIG. 2A, reversing the bidirectional flow of the refrigerant fluid circuit 200*a*, such as by switching the direction of flow controlled by the switch over valve 222, may not reverse the flow of the refrigerant fluid through the auxiliary heat exchanger 214. The auxiliary heat exchanger 214 may be the same or similar to the auxiliary heat exchanger 114 described above. In still further examples, the auxiliary heat exchanger 214 may be optionally configured with an auxiliary fan 224 as shown. The auxiliary fan 224 may be configured to assist the outdoor fan 218 with providing airflow and thereby generally increase heat transfer between the refrigerant fluid and the air. However, in general, a primary outdoor fan, e.g., outdoor fan 218, may often be used to provide airflow over both the primary heat exchanger 226 and the auxiliary heat exchanger 214.

After exiting the auxiliary heat exchanger 214 the refrigerant fluid generally passes to the switch over valve 222 and then onto the primary outdoor heat exchanger 226. It should be understood that the switch over valve 222 may be configured to adjust the direction of the flow of the refrigerant fluid between the primary outdoor heat exchanger 226, e.g., in an L-shaped configuration, and an indoor heat exchanger 208 of the climate control system 400 as described in more detail below. In some examples, the primary outdoor heat exchanger 226 may be configured with a sensor 228 configured to monitor refrigerant fluid conditions therein, e.g., temperatures, pressures, airflow rate, refrigerant flow rate, or the like.

Still referring to FIG. 2A, as the refrigerant fluid leaves the primary outdoor heat exchanger 226, the refrigerant fluid continues to flow through a plurality of components, as illustrated, including: an outdoor metering device 220, a service valve 230, a filter drier 232, a strainer 234, an indoor metering device 212, an indoor heat exchanger 208, and a service valve 236. The refrigerant fluid may then generally pass back to the switch over valve 222 and repeat the refrigerant fluid circuit 200*a*. In some examples, the outdoor metering device 220 may be bypassed and an internal or external check valve may be used to direct fluid around the outdoor metering device 220, typically when the refrigerant fluid is circulated in a cooling mode.

Turning now to the refrigerant fluid circuit 200*b* as shown in FIG. 2B, the refrigerant fluid generally follows the same flow path as described above with respect to refrigerant fluid circuit 200*a*. However, as illustrated in FIG. 2B, the auxiliary heat exchanger 214 may be fluidly arranged in series between the switch over valve 222 and the primary outdoor heat exchanger 226, e.g., the auxiliary heat exchanger 214 may be fluidly coupled at a first end to the switch over valve 222 and may be further fluidly coupled at another end to the primary outdoor heat exchanger 226. In the arrangement of FIG. 2B, switching the switch over valve 222 would have the result of reversing the direction of flow of refrigerant through the auxiliary heat exchanger 214.

In some examples, such as depicted in FIG. 2B, the auxiliary heat exchanger 214 may include a plurality of heat exchanger circuits for refrigerant flow. The plurality of heat exchanger circuits may be defined by a plurality of parallel pipes 214*c*, as shown, each of the plurality of parallel pipes 214*c* defining an individual flow path for refrigerant flow. In such examples, the auxiliary heat exchanger 214 may further include a distributor 214*a* and a distributor 214*b* for distributing refrigerant fluid between each of the plurality of parallel pipes 214*c*. In some examples, one or more parallel pipes of the plurality of parallel pipes 214*c* may define a respective auxiliary heat exchanger. In some examples, the plurality of parallel pipes 214*c* may be substituted for one continuous pathway for refrigerant flow the same, or substantially similar to, the plurality of pipes 114*a* as described above with respect to FIG. 1B.

In some examples, the bypass circuit 207 including bypass valve 207*a* and/or bypass valve 207*b*, as depicted in FIG. 2B, may be included to allow the refrigerant to bypass the auxiliary heat exchanger 214. Further, as shown, this bypass circuit 207 also includes a check valve 240. The depicted example shows the check valve 240 used in addition to bypass valves 207*a* and 207*b*, however, it is understood that the bypass check valve 240 may be used without one or either of these valves, or in some examples, the check valve 240 may not be used. It should be further appreciated, that such a check valve configuration may automatically include and/or exclude the auxiliary heat exchanger 214 without the need for additional controller logic and/or electronic bypass valve switching. For example, the bypass check valve 240 may only allow refrigerant to flow in one direction, and thus, for example, it may only allow the refrigerant fluid to bypass the auxiliary heat exchanger during heating mode. Further, in some examples, this bypass circuit may function similar to the bypass circuit discussed above. It should be understood that, in some examples, the auxiliary heat exchanger 214 may be configured in series with at least one component of any of the refrigerant fluid circuits 200 or the like as described by the present disclosure.

Referring now to the refrigerant fluid circuit 200*c* as shown in FIG. 2C, the refrigerant fluid may generally follow the same flow path as described above with respect to refrigerant fluid circuit 200*a*. As illustrated in FIG. 2C, however, the auxiliary heat exchanger 214 may be fluidly arranged in parallel with the primary outdoor heat exchanger 226. In the depicted examples, the flow of refrigerant between the auxiliary heat exchanger 214 and the primary outdoor heat exchanger 226 may, optionally, be regulated by one or more modulating valves 238. In some examples, check valves 240 are included to control the flow of refrigerant between the main circuit and the auxiliary heat exchangers 214 and 215. These check valves may be designed to allow flow these auxiliary heat exchangers during cooling mode, but not heating mode. In some examples, these check valves are used without any additional modulating valve 238 to control the flow of refrigerant between the auxiliary heat exchanger 214 and the primary outdoor heat exchanger 226.

In some examples, the flow of refrigerant may divide between the auxiliary heat exchanger 214 and the primary outdoor heat exchanger 226 at a point along the refrigerant fluid circuit 200*c* common to both the auxiliary heat exchanger 214 and the primary outdoor heat exchanger 226, e.g., at one or more modulating valves 238 or if no modulating valves are used than at tee joints or similar joints located at the locations depicted for modulating valves 238. In some examples, the flow of refrigerant between the auxiliary heat exchanger 214 and the primary outdoor heat exchanger 226 may be proportional to one or more dimensions common to each heat exchanger, e.g., the internal diameter of tubing of each heat exchanger, the flow path length of each heat exchanger, or the like. For additional examples, a dimension common to both the auxiliary heat exchanger 214 and the primary outdoor heat exchanger 226 may be an interior length, width, or diameter, of respective capillary tubing of each of the auxiliary heat exchanger 214 and the primary outdoor heat exchanger 226. In one example, the primary outdoor heat exchanger 226 includes a plurality of circuits and the auxiliary heat exchanger 214 includes at least one additional circuit, and refrigerant is passively dividing between the circuits of the primary and auxiliary heat exchangers by a distributor, e.g., a distributor 214*a* and/or a distributor 214*b*. In some examples, the refrigerant fluid circuit 200*c* may further include one or more additional auxiliary heat exchangers 215 in parallel with the auxiliary heat exchanger 214 and the primary outdoor heat exchanger 226. In some examples, the one or more additional auxiliary heat exchangers 215 may be in series with the auxiliary heat exchanger 214 and in parallel with the primary outdoor heat exchanger 226. In some examples, the one or more modulating valves 238 may bypass the auxiliary heat exchanger 214 and only direct refrigerant fluid through the primary outdoor heat exchanger 226.

Moreover, it should be understood that in the depicted examples of FIG. 2B-2C, reversing the bidirectional flow of the refrigerant fluid circuit 200*b* and/or 200*c*, such as by switching the direction of flow controlled by the switch over valve 222, may also reverse the flow of the refrigerant fluid through the auxiliary heat exchanger 214.

Figure 3:
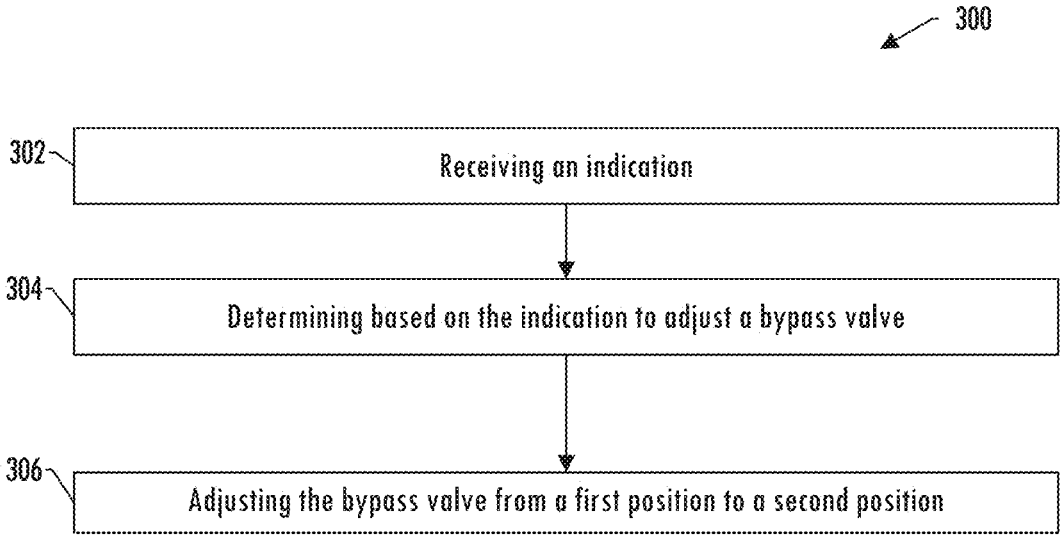
FIG. 3 illustrates a process for operating climate control systems with an auxiliary heat exchanger, according to some example implementations of the present disclosure.
Figure 5:
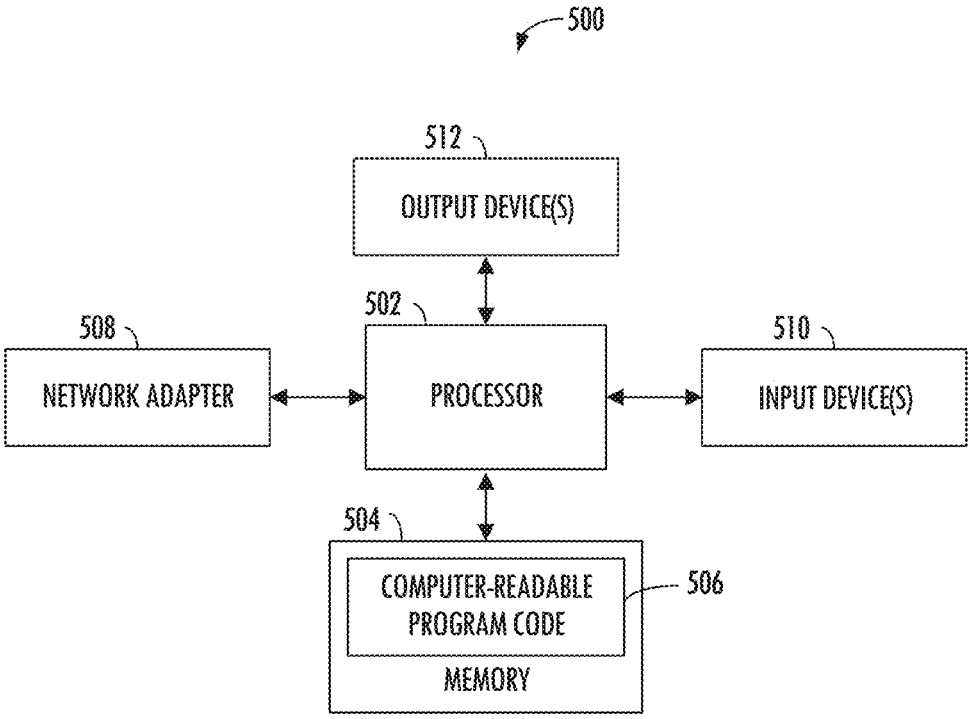
FIG. 5 illustrates control circuitry, according to some example implementations of the present disclosure.

FIG. 3 shows an example process 300 that may be utilized to temporarily bypass the auxiliary heat exchanger 214. The process 300 may be carried out, at least partially, by one or more apparatuses, components, circuits, or the like according to some examples of the present disclosure. In some examples, the process 300 may be performed by at least control circuitry 500 as illustrated in FIG. 5 and described below. In some examples, the process 300 may utilize one or more other components communicably connected to the control circuitry 500 and/or fluidly coupled to the refrigerant fluid circuit 200, e.g., components of the bypass circuit 207 including the bypass valve 207*a* and the bypass valve 207*b*.

As shown in FIG. 3, the process 300 may include receiving an indication, as shown in step 302. The indication may be indicative of one or more conditions associated with a climate control system, e.g., a user indication, a sensor indication, a combination thereof, or the like. For example, a user may provide an indication via a thermostat requesting heating capacity, cooling capacity, or the like from a climate control system that incorporates the outdoor side-discharge unit 100 or the like. For additional examples, a sensor of the refrigerant fluid circuit may provide an indication of refrigerant fluid pressure, temperature, flowrate, or flow direction along a point of the refrigerant fluid circuit.

The process 300 may further include determining based on the indication to adjust a bypass valve, as shown in step 304. In some examples, the system controller of the climate control system may receive the indication and compare that indication to a current position of the bypass valve. For example, the indication may be a request for heating capacity and the controller may determine that the bypass valve is currently positioned to include the auxiliary heat exchanger in the refrigerant fluid circuit which, in some examples, may be detrimental to providing heating capacity.

The process 300 may further include adjusting the bypass valve from a first position to a second position, as shown in step 306. For example, the system controller of the climate control system may electronically adjust the position of one or more bypass valves to bypass the auxiliary heat exchanger within the refrigerant fluid circuit. The bypass valves may be controlled remotely by a system controller. The process 300 may be further reiterated to return the bypass valve from the second position to the first position, e.g., based on a request for cooling capacity, diagnostic testing for leaks, or the like.

Figure 4:
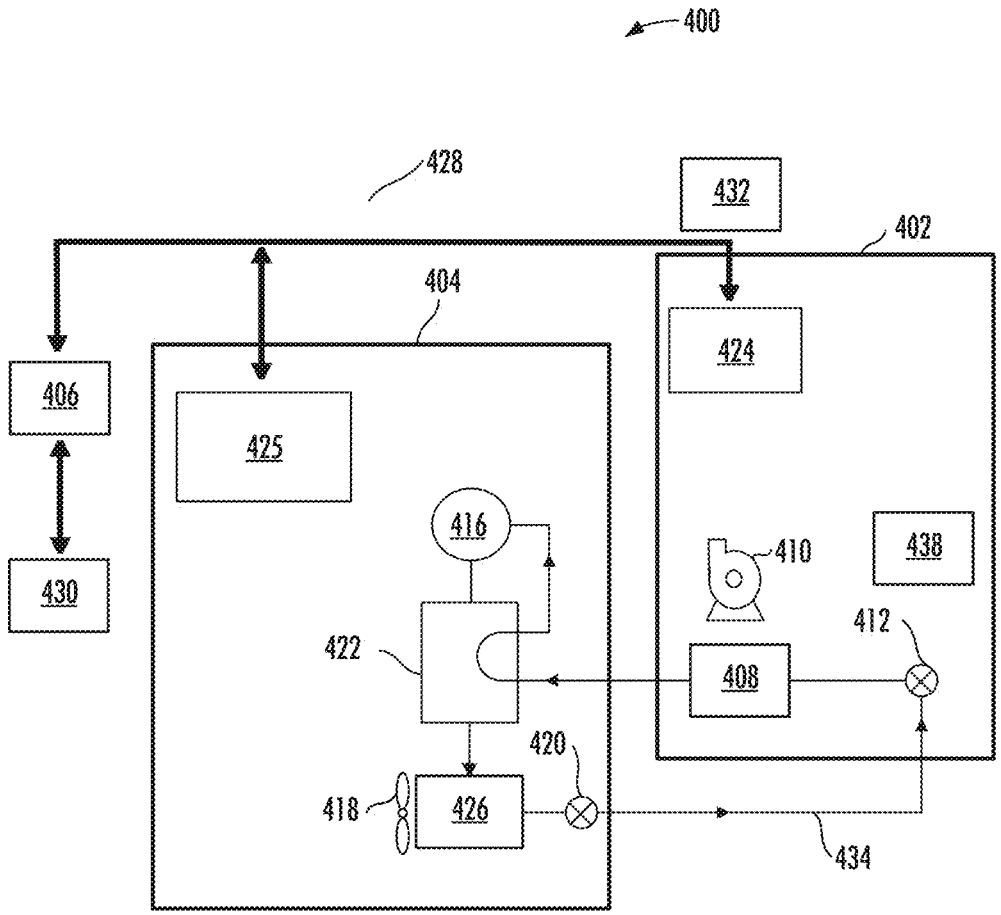
FIG. 4 illustrates a schematic diagram of a climate control system, according to some example implementations of the present disclosure.

FIG. 4 shows a schematic diagram for at least an example climate control system 400. In some examples, the climate control system 400 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The examples depicted in FIG. 4 are configured in a cooling mode. The climate control system 400, in some examples is configured as a split system heat pump system, and generally comprises an indoor unit 402, an outdoor unit 404, and a system controller 406 that may generally control operation of the indoor unit 402 and/or the outdoor unit 404. The refrigerant fluid circuit 434, which may be the same or similar to the refrigerant fluid circuit 200 discussed above, fluidly couples the indoor unit 402 and the outdoor unit 404.

Indoor unit 402 generally comprises an indoor air handling unit comprising an indoor heat exchanger 408, an indoor fan 410, an indoor metering device 412, and an indoor controller 424. The indoor heat exchanger 408 may generally be configured to promote heat exchange between a refrigerant fluid carried within internal tubing of the indoor heat exchanger 408 and an airflow that may contact the indoor heat exchanger 408 but that is segregated from the refrigerant fluid. Indoor unit 402 may be coupled to a duct system 432 including one or more of a duct, an air inlet/outlet, a register, a vent, a damper, an air filter, a louver, or the like for conveying or directing conditioned air to, from, or through one or more of a conditioned space, unconditioned space, outdoor space, or liminal space (e.g., between or through walls, ceilings, floors, etc.).

The indoor metering device 412 may generally comprise an electronically-controlled motor-driven electronic expansion valve (EEV). In some examples, however, the indoor metering device 412 may comprise a thermostatic expansion valve, a capillary tube assembly, and/or any other suitable metering device.

As depicted in FIG. 4, the climate control system 400 includes an outdoor unit 404 which may be the same or similar to the outdoor side-discharge unit 100 discussed above. Outdoor unit 404 generally comprises a primary outdoor heat exchanger 426, a compressor 416, an outdoor fan 418, an outdoor metering device 420, a switch over valve 422, and an outdoor controller 425. The primary outdoor heat exchanger 426 may generally be configured to promote heat transfer between a refrigerant fluid carried within internal passages of the primary outdoor heat exchanger 426 and an airflow that contacts the primary outdoor heat exchanger 426 but is segregated from the refrigerant fluid.

The outdoor metering device 420 may generally comprise a thermostatic expansion valve. In some examples, however, the outdoor metering device 420 may comprise an electronically-controlled motor driven EEV similar to indoor metering device 412, a capillary tube assembly, and/or any other suitable metering device. In some examples, the outdoor metering device 420 may further include a check valve configured to at least partially bypass the thermostatic expansion valve, the electronically-controlled motor driven EEV, or the like.

In some examples, the switch over valve 422 may generally comprise a four-way reversing valve. The switch over valve 422 may also comprise an electrical solenoid, relay, and/or other device configured to selectively move a component of the switch over valve 422 between operational positions to alter the flow path of refrigerant fluid through the switch over valve 422 and consequently the climate control system 400. Additionally, the switch over valve 422 may also be selectively controlled by the system controller 406, an outdoor controller 425, and/or the indoor controller 424.

The system controller 406 may generally be configured to selectively communicate with the indoor controller 424 of the indoor unit 402, the outdoor controller 425 of the outdoor unit 404, and/or other components of the climate control system 400. In some examples, the system controller 406 may be configured to control operation of the indoor unit 402, and/or the outdoor unit 404. In some examples, the system controller 406 may be configured to monitor and/or communicate with a plurality of temperature and pressure sensors, or the like, associated with components of the indoor unit 402, the outdoor unit 404, and/or the outdoor ambient environment.

Additionally, in some examples, the system controller 406 may comprise a temperature sensor and/or may further be configured to control heating and/or cooling of conditioned spaces or zones associated with the climate control system 400. In other examples, the system controller 406 may be configured as a thermostat for controlling the supply of conditioned air to zones associated with the climate control system 400, and in some examples, the thermostat may include a temperature sensor.

The system controller 406 may also generally comprise an input/output (I/O) unit (e.g., a graphical user interface, a touchscreen interface, or the like) for displaying information and for receiving user inputs. The system controller 406 may display information related to the operation of the climate control system 400 and may receive user inputs related to operation of the climate control system 400. However, the system controller 406 may further be operable to display information and receive user inputs tangentially related and/or unrelated to operation of the climate control system 400. In some examples, the system controller 406 may not comprise a display and may derive all information from inputs that come from remote sensors and remote configuration tools.

In some examples, the system controller 406 may be configured for selective bidirectional communication over a communication bus 428, which may utilize any type of communication network. For example, the communication may be via wired or wireless data links directly or across one or more networks, such as a control network. Examples of suitable communication protocols for the control network include CAN, TCP/IP, BACnet, LonTalk, Modbus, ZigBee, Zwave, Wi-Fi, SIMPLE, Bluetooth, and the like.

The indoor controller 424 may be carried by the indoor unit 402 and may generally be configured to receive information inputs, transmit information outputs, and/or otherwise communicate with the system controller 406, the outdoor controller 425, and/or any other device 430 via the communication bus 428 and/or any other suitable medium of communication. In some examples, the device 430 may include some or all systems or any components thereof described with respect to the figures, and/or any other components, devices, or apparatuses described by the present disclosure.

The indoor Electronic Expansion Valve (EEV) controller 438 may be configured to receive information regarding temperatures and/or pressures of the refrigerant fluid in the indoor unit 402. More specifically, the indoor EEV controller 438 may be configured to receive information regarding temperatures and pressures of refrigerant fluid entering, exiting, and/or within the indoor heat exchanger 408.

The outdoor controller 425 may be carried by the outdoor unit 404 and may be configured to receive information inputs from the system controller 406, which may be a thermostat. In some examples, the outdoor controller 425 may be configured to receive information related to an ambient temperature associated with the outdoor unit 404, information related to a temperature of the primary outdoor heat exchanger 426, and/or information related to refrigerant fluid temperatures and/or pressures of refrigerant fluid entering, exiting, and/or within the primary outdoor heat exchanger 426 and/or the compressor 416.

Various different heat exchangers and configurations thereof are described by the present disclosure above. It should be understood that, in some examples, the various different heat exchangers described by the present disclosure may include various different types of heat exchangers. Examples of the various different types of heat exchangers that may be utilized by the various different example implementations of the present disclosure include one or more of a plate heat exchanger, plate shaped heat exchanger, pillow plate heat exchanger, straight pipe heat exchanger, helical-coil pipe heat exchanger, pipe and joint heat exchanger, multi-pass heat exchanger, parallel flow heat exchanger, L-shaped heat exchanger, U-shaped heat exchanger, two-row heat exchanger, double-pipe heat exchanger, shell-and-tube heat exchanger, plate-and-shell heat exchanger, plate fin heat exchanger, finned tube heat exchanger, tubular heat exchanger, microchannel heat exchanger, spiral heat exchanger, phase-change heat exchanger, jacket heat exchanger, the like, or any other device for providing heat transfer between at least two mediums associated with at least a climate control system as described by the present disclosure.

FIG. 5 illustrates the control circuitry 500, which may be an apparatus, according to some examples of the present disclosure. In some examples, the control circuitry may include one or more of each of a number of components such as, for example, a processor 502 connected to a memory 504. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 502 may be a number of processors, a multi-core processor or some other type of processor, depending on the particular example.

The processor 502 may be configured to execute computer programs such as computer-readable program code 506, which may be stored onboard the processor or otherwise stored in the memory 504. In some examples, the processor may be embodied as or otherwise include one or more ASICs, FPGAs or the like. Thus, although the processor may be capable of executing a computer program to perform one or more functions, the processor of various examples may be capable of performing one or more functions without the aid of a computer program.

The memory 504 is generally any piece of computer hardware capable of storing information such as, for example, data, computer-readable program code 506 or other computer programs, and/or other suitable information either on a temporary basis and/or a permanent basis. The memory may include volatile memory such as random access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 502, causes the control circuitry 500 to perform various operations as described herein, some of which may in turn cause the HVAC system to perform various operations.

In addition to the memory 504, the processor 502 may also be connected to one or more peripherals such as a network adapter 508, one or more input/output (I/O) devices (e.g., input device(s) 510, output device(s) 512) or the like. The network adapter is a hardware component configured to connect the control circuitry 500 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A side-discharge outdoor unit of a climate control system comprising: an enclosure defining an interior space and an exterior boundary of the side-discharge outdoor unit; a compressor located within the enclosure and configured to circulate a refrigerant fluid within a refrigerant fluid circuit of the climate control system; an L-shaped primary heat exchanger located within the enclosure and coupled to the refrigerant fluid circuit, the L-shaped primary heat exchanger being configured to transfer thermal energy between the refrigerant fluid circuit and an external environment; a plate shaped auxiliary heat exchanger located within the enclosure and coupled to the refrigerant fluid circuit, the plate shaped auxiliary heat exchanger being configured to transfer thermal energy between the refrigerant fluid circuit and the external environment, and an outdoor fan located within the enclosure and configured to provide an airflow from the external environment to contact at least the L-shaped primary heat exchanger and the plate shaped auxiliary heat exchanger, wherein the enclosure includes: a heat exchanger guard defining the exterior boundary for a first section, the first section located along one or more sides of the enclosure, wherein the L-shaped primary heat exchanger is disposed within the interior space along a portion of the first section proximate the heat exchanger guard, a cover plate defining the exterior boundary for a second section and including a plurality of openings, the second section located on a top of the enclosure, wherein the plate shaped auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, and wherein the outdoor fan is aligned axially with the airflow opening, wherein the second section spans between the first section and the third section.

Clause 2. The side-discharge outdoor unit in any of the clauses, wherein the L-shaped primary heat exchanger and the plate shaped auxiliary heat exchanger are fluidly arranged in series within the refrigerant fluid circuit.

Clause 3. The side-discharge outdoor unit in any of the clauses, further comprising a switch over valve (SOV) coupled to the refrigerant fluid circuit configured to adjust a direction of flow of the refrigerant fluid between the primary L-shaped heat exchanger and an indoor heat exchanger of the climate control system, wherein the auxiliary heat exchanger is fluidly coupled to the refrigerant fluid circuit between a discharge port of the compressor and the switch over valve, wherein the auxiliary heat exchanger is arranged such that adjusting the direction of flow of the refrigerant by switching a position of the SOV does not reverse the flow of the refrigerant fluid through the auxiliary heat exchanger.

Clause 4. The side-discharge outdoor unit in any of the clauses, further comprising a switch over valve (SOV) coupled to the refrigerant fluid circuit configured to adjust a direction of flow of the refrigerant fluid between the primary L-shaped heat exchanger and an indoor heat exchanger of the climate control system, wherein the auxiliary heat exchanger is fluidly coupled to the refrigerant fluid circuit between the L-shaped primary heat exchanger and the switch over valve, wherein the auxiliary heat exchanger is arranged such that adjusting the direction of flow of the refrigerant by switching a position of the SOV reverses the flow of the refrigerant fluid through the auxiliary heat exchanger.

Clause 5. The side-discharge outdoor unit in any of the clauses, wherein the L-shaped primary heat exchanger and the plate shaped auxiliary heat exchanger are fluidly arranged in parallel within the refrigerant fluid circuit.

Clause 6. The side-discharge outdoor unit in any of the clauses, wherein the heat exchanger guard defines a height dimension of the side-discharge outdoor unit, the height dimension being a vertical length of the heat exchanger guard along a vertical axis of the side-discharge outdoor unit in an installed configuration, wherein the cover plate defines a width dimension and a depth dimension of the side-discharge outdoor unit, the width dimension being a first horizontal length of the cover plate along a first horizontal axis of the side-discharge outdoor unit in an installed configuration, the first horizontal axis being orthogonal to the vertical axis, and the depth dimension being a second horizontal length of the cover plate along a second horizontal axis of the side-discharge outdoor unit in an installed configuration, the second horizontal axis being orthogonal to both the vertical axis and the first horizontal axis, wherein the height dimension is greater than the width dimension, and the width dimension is greater than the depth dimension, wherein the outdoor fan includes a fan depth dimension, the fan depth dimension being an axial length of the outdoor fan along a central axis of the outdoor fan in an installed configuration, the central axis being normal to a plane defined by a circulation path of an impeller of the outdoor fan, wherein the depth dimension of the side-discharge outdoor unit is greater than the fan depth dimension by a given depth factor, the given depth factor being a value less than 2.

Clause 7. The side-discharge outdoor unit in any of the clauses, wherein the heat exchanger guard defines a height dimension of the side-discharge outdoor unit, the height dimension being a vertical length of the heat exchanger guard along a vertical axis of the side-discharge outdoor unit in an installed configuration, wherein the cover plate defines a width dimension and a depth dimension of the side-discharge outdoor unit, the width dimension being a first horizontal length of the cover plate along a first horizontal axis of the side-discharge outdoor unit in an installed configuration, the first horizontal axis being orthogonal to the vertical axis, and the depth dimension being a second horizontal length of the cover plate along a second horizontal axis of the side-discharge outdoor unit in an installed configuration, the second horizontal axis being orthogonal to both the vertical axis and the first horizontal axis, wherein the height dimension is greater than the width dimension, and the width dimension is greater than the depth dimension, wherein the outdoor fan includes a fan height dimension, the fan height dimension being a radial length of the outdoor fan along a plane defined by a circulation path of an impeller of the outdoor fan in an installed configuration, wherein the height dimension of the side-discharge outdoor unit is greater than the fan height dimension by a given height factor, the given height factor being a value less than 1.5.

Clause 8. The side-discharge outdoor unit in any of the clauses, wherein the plate shaped auxiliary heat exchanger includes a plurality of heat exchanger circuits, the plurality of heat exchanger circuits fluidly arranged in parallel.

Clause 9. The side-discharge outdoor unit in any of the clauses, wherein the outdoor fan includes a first outdoor fan and a second outdoor fan, and the airflow opening includes a first airflow opening and a second airflow opening, wherein the first outdoor fan is aligned axially with the first airflow opening and the second outdoor fan is aligned axially with the second airflow opening.

Clause 10. The side-discharge outdoor unit in any of the clauses, wherein the cover plate further includes a plurality of angled tabs, and wherein each of the plurality of angled tabs is aligned with each of the plurality of openings disposed in the cover plate.

Clause 11. The side-discharge outdoor unit in any of the clauses, wherein the plurality of angled tabs are arranged parallel to an edge of the cover plate and extend at least partially upwards at an angle, the angle configured to direct airflow to contact the auxiliary heat exchanger.

Clause 12. A side-discharge outdoor unit of a climate control system comprising: an enclosure defining an interior space and an exterior boundary of the side-discharge outdoor unit; a compressor located within the enclosure and configured to circulate a refrigerant fluid within a refrigerant fluid circuit of the climate control system; a primary heat exchanger located within the enclosure and coupled to the refrigerant fluid circuit, the primary heat exchanger being configured to transfer thermal energy between the refrigerant fluid circuit and an external environment; an auxiliary heat exchanger located within the enclosure and coupled to the refrigerant fluid circuit, wherein the primary heat exchanger and the auxiliary heat exchanger are fluidly arranged in series within the refrigerant fluid circuit and the auxiliary heat exchanger is configured to transfer thermal energy between the refrigerant fluid circuit and the external environment, and an outdoor fan located within the enclosure and configured to provide an airflow from the external environment to contact at least the primary heat exchanger and the auxiliary heat exchanger, wherein the enclosure includes: a heat exchanger guard defining the exterior boundary for a first section, the first section located along one or more sides of the enclosure, wherein the primary heat exchanger is disposed within the interior space along a portion of the first section proximate the heat exchanger guard, a cover plate defining the exterior boundary for a second section and including a plurality of openings and a plurality of angled slats aligned with the plurality of openings, the second section located on a top of the enclosure, wherein the auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, and wherein the outdoor fan is aligned radial with the airflow opening, wherein the second section spans between the first section and the third section.

Clause 13. The side-discharge outdoor unit in any of the clauses, wherein the primary heat exchanger is an L-shaped heat exchanger.

Clause 14. The side-discharge outdoor unit in any of the clauses, further comprising a switch over valve (SOV) coupled to the refrigerant fluid circuit configured to adjust a direction of flow of the refrigerant fluid between the primary heat exchanger and an indoor heat exchanger of the climate control system, wherein the auxiliary heat exchanger is fluidly coupled to the refrigerant fluid circuit between a discharge port of the compressor and the switch over valve, wherein the auxiliary heat exchanger is arranged such that adjusting the direction of flow of the refrigerant by switching a position of the SOV does not reverse the flow of the refrigerant fluid of the refrigerant fluid circuit through the auxiliary heat exchanger.

Clause 15. The side-discharge outdoor unit in any of the clauses, further comprising a switch over valve (SOV) coupled to the refrigerant fluid circuit configured to adjust a direction of flow of the refrigerant fluid between the primary heat exchanger and an indoor heat exchanger of the climate control system, wherein the auxiliary heat exchanger is fluidly coupled to the refrigerant fluid circuit between the primary heat exchanger and the switch over valve, wherein the auxiliary heat exchanger is arranged such that adjusting the direction of flow of the refrigerant by switching a position of the SOV reverses the flow of the refrigerant fluid of the refrigerant fluid circuit through the auxiliary heat exchanger.

Clause 16. The side-discharge outdoor unit in any of the clauses, wherein the auxiliary heat exchanger is a plate shaped auxiliary heat exchanger and includes a plurality of heat exchanger circuits, the plurality of heat exchanger circuits fluidly arranged in parallel.

Clause 17. A side-discharge outdoor unit of a climate control system comprising: an enclosure defining an interior space and an exterior boundary of the side-discharge outdoor unit; a compressor located within the enclosure and configured to circulate a refrigerant fluid within a refrigerant fluid circuit of the climate control system; a primary heat exchanger located within the enclosure and coupled to the refrigerant fluid circuit, the primary heat exchanger being configured to transfer thermal energy between the refrigerant fluid circuit and an external environment; an auxiliary heat exchanger located within the enclosure and coupled to the refrigerant fluid circuit, wherein the primary heat exchanger and the auxiliary heat exchanger are fluidly arranged in parallel within the refrigerant fluid circuit and the auxiliary heat exchanger is configured to transfer thermal energy between the refrigerant fluid circuit and the external environment; and an outdoor fan located within the enclosure and configured to provide an airflow from the external environment to contact at least the primary heat exchanger and the auxiliary heat exchanger, wherein the enclosure includes: a heat exchanger guard defining the exterior boundary for a first section, the first section located along one or more sides of the enclosure, wherein the primary heat exchanger is disposed within the interior space along a portion of the first section proximate the heat exchanger guard, a cover plate defining the exterior boundary for a second section and including a plurality of openings and a plurality of angled slats aligned with the plurality of openings, the second section located on a top of the enclosure, wherein the auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, and wherein the outdoor fan is aligned radial with the airflow opening, wherein the second section spans between the first section and the third section.

Clause 18. The side-discharge outdoor unit in any of the clauses, wherein the primary heat exchanger is an L-shaped heat exchanger.

Clause 19. The side-discharge outdoor unit in any of the clauses, wherein the refrigerant fluid is divided between the auxiliary heat exchanger and the primary outdoor heat exchanger at a point of the refrigerant fluid circuit common to both the auxiliary heat exchanger and the primary outdoor heat exchanger, and wherein the refrigerant fluid is divided proportional to a dimension common to both the auxiliary heat exchanger and the primary outdoor heat exchanger.

Clause 20. The side-discharge outdoor unit in any of the clauses, wherein the dimension common to both the auxiliary heat exchanger and the primary outdoor heat exchanger being an interior width of a respective capillary tube of each of the auxiliary heat exchanger and the primary outdoor heat exchanger.

Many modifications, other embodiments, examples, or implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific embodiments, examples, or implementations disclosed and that modifications and other embodiments, examples, or implementations are intended to be included within the scope of the appended claims. Moreover, although the foregoing description and the associated figures describe embodiments, examples, or implementations in the context of certain example combinations of elements and/or functions, it should be appreciated that different combinations of elements and/or functions may be provided by alternative embodiments, examples, or implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A side-discharge outdoor unit of a climate control system comprising:

an enclosure defining an interior space and an exterior boundary of the side-discharge outdoor unit;

a compressor located within the enclosure and configured to circulate a refrigerant fluid within a refrigerant fluid circuit of the climate control system;

an L-shaped primary heat exchanger located within the enclosure and coupled to the refrigerant fluid circuit, the L-shaped primary heat exchanger being configured to transfer thermal energy between the refrigerant fluid circuit and an external environment;

a plate shaped auxiliary heat exchanger located within the enclosure and coupled to the refrigerant fluid circuit, the plate shaped auxiliary heat exchanger being configured to transfer thermal energy between the refrigerant fluid circuit and the external environment;

an outdoor fan located within the enclosure and configured to provide an airflow from the external environment to contact at least the L-shaped primary heat exchanger and the plate shaped auxiliary heat exchanger; and a switch over valve (SOV) coupled to the refrigerant fluid circuit configured to adjust a direction of flow of the refrigerant fluid between the primary L-shaped heat exchanger and an indoor heat exchanger of the climate control system, wherein the enclosure includes:

a heat exchanger guard defining the exterior boundary for a first section, the first section located along one or more sides of the enclosure, wherein the L-shaped primary heat exchanger is disposed within the interior space along a portion of the first section proximate the heat exchanger guard, a cover plate defining the exterior boundary for a second section and including a plurality of openings, the second section located on a top of the enclosure, wherein the plate shaped auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, wherein the outdoor fan is aligned axially with the airflow opening, and wherein the second section spans between the first section and the third section, wherein the L-shaped primary heat exchanger and the plate shaped auxiliary heat exchanger are fluidly arranged in series within the refrigerant fluid circuit, and wherein the auxiliary heat exchanger is fluidly coupled to the refrigerant fluid circuit between a discharge port of the compressor and the switch over valve such that both an inlet and an outlet to the auxiliary heat exchanger are coupled to the refrigerant fluid circuit between the discharge port of the compressor and the switch over valve.

2. The side-discharge outdoor unit of claim 1, wherein the auxiliary heat exchanger is arranged such that adjusting the direction of flow of the refrigerant by switching a position of the SOV does not reverse the flow of the refrigerant fluid through the auxiliary heat exchanger.

3. The side-discharge outdoor unit of claim 1, wherein the heat exchanger guard defines a height dimension of the side-discharge outdoor unit, the height dimension being a vertical length of the heat exchanger guard along a vertical axis of the side-discharge outdoor unit in an installed configuration, wherein the cover plate defines a width dimension and a depth dimension of the side-discharge outdoor unit, the width dimension being a first horizontal length of the cover plate along a first horizontal axis of the side-discharge outdoor unit in an installed configuration, the first horizontal axis being orthogonal to the vertical axis, and the depth dimension being a second horizontal length of the cover plate along a second horizontal axis of the side-discharge outdoor unit in an installed configuration, the second horizontal axis being orthogonal to both the vertical axis and the first horizontal axis, wherein the height dimension is greater than the width dimension, and the width dimension is greater than the depth dimension, wherein the outdoor fan includes a fan depth dimension, the fan depth dimension being an axial length of the outdoor fan along a central axis of the outdoor fan in an installed configuration, the central axis being normal to a plane defined by a circulation path of an impeller of the outdoor fan, wherein the depth dimension of the side-discharge outdoor unit is greater than the fan depth dimension by a given depth factor, the given depth factor being a value less than 2.

4. The side-discharge outdoor unit of claim 1, wherein the heat exchanger guard defines a height dimension of the side-discharge outdoor unit, the height dimension being a vertical length of the heat exchanger guard along a vertical axis of the side-discharge outdoor unit in an installed configuration, wherein the cover plate defines a width dimension and a depth dimension of the side-discharge outdoor unit, the width dimension being a first horizontal length of the cover plate along a first horizontal axis of the side-discharge outdoor unit in an installed configuration, the first horizontal axis being orthogonal to the vertical axis, and the depth dimension being a second horizontal length of the cover plate along a second horizontal axis of the side-discharge outdoor unit in an installed configuration, the second horizontal axis being orthogonal to both the vertical axis and the first horizontal axis, wherein the height dimension is greater than the width dimension, and the width dimension is greater than the depth dimension, wherein the outdoor fan includes a fan height dimension, the fan height dimension being a radial length of the outdoor fan along a plane defined by a circulation path of an impeller of the outdoor fan in an installed configuration, wherein the height dimension of the side-discharge outdoor unit is greater than the fan height dimension by a given height factor, the given height factor being a value less than 1.5.

5. The side-discharge outdoor unit of claim 1, wherein the plate shaped auxiliary heat exchanger includes a plurality of heat exchanger circuits, the plurality of heat exchanger circuits fluidly arranged in parallel.

6. The side-discharge outdoor unit of claim 1, wherein the outdoor fan includes a first outdoor fan and a second outdoor fan, and the airflow opening includes a first airflow opening and a second airflow opening, wherein the first outdoor fan is aligned axially with the first airflow opening and the second outdoor fan is aligned axially with the second airflow opening.

7. The side-discharge outdoor unit of claim 1, wherein the cover plate further includes a plurality of angled tabs, wherein each of the plurality of angled tabs defines at least one of the plurality of openings disposed in the cover plate.

8. The side-discharge outdoor unit of claim 7, wherein the plurality of angled tabs are arranged parallel to an edge of the cover plate and extend at least partially upwards at an angle, the angle configured to direct airflow to contact the auxiliary heat exchanger.

9. The side-discharge unit of claim 1, further comprising a bypass circuit configured to selectively exclude the plate shaped auxiliary heat exchanger from the refrigerant fluid circuit.

10. The side-discharged unit of claim 9, further comprising a modulating valve configured to control the bypass line, the bypass valve configured to selectively exclude the plate shaped auxiliary heat exchanger from the refrigerant fluid circuit in heating mode.

11. The side-discharged unit of claim 1, wherein the second section may be generally perpendicular to each of the first section and the third section.

12. A side-discharge outdoor unit of a climate control system comprising:

an enclosure defining an interior space and an exterior boundary of the side-discharge outdoor unit;

a compressor located within the enclosure and configured to circulate a refrigerant fluid within a refrigerant fluid circuit of the climate control system;

a primary heat exchanger located within the enclosure and coupled to the refrigerant fluid circuit, the primary heat exchanger being configured to transfer thermal energy between the refrigerant fluid circuit and an external environment;

an auxiliary heat exchanger located within the enclosure and coupled to the refrigerant fluid circuit, wherein the primary heat exchanger and the auxiliary heat exchanger are fluidly arranged in series within the refrigerant fluid circuit and the auxiliary heat exchanger is configured to transfer thermal energy between the refrigerant fluid circuit and the external environment;

a switch over valve (SOV) coupled to the refrigerant fluid circuit configured to adjust a direction of flow of the refrigerant fluid between the primary heat exchanger and an indoor heat exchanger of the climate control system; and an outdoor fan located within the enclosure and configured to provide an airflow from the external environment to contact at least the primary heat exchanger and the auxiliary heat exchanger, wherein the enclosure includes:

a heat exchanger guard defining the exterior boundary for a first section, the first section located along one or more sides of the enclosure, wherein the primary heat exchanger is disposed within the interior space along a portion of the first section proximate the heat exchanger guard, a cover plate defining the exterior boundary for a second section and including a plurality of angled slats defining a plurality of openings, the second section located on a top of the enclosure, wherein the auxiliary heat exchanger is disposed within the interior space along a portion of the second section proximate the cover plate, a side panel section including an airflow opening and defining the exterior boundary of a third section, the third section adjacent the first section and located along one or more sides of the enclosure, and the airflow opening configured to allow an airflow between the interior space and the external environment, wherein the outdoor fan is aligned radial with the airflow opening, and wherein the second section spans between the first section and the third section, wherein the auxiliary heat exchanger is fluidly coupled to the refrigerant fluid circuit between a discharge port of the compressor and the switch over valve such that both an inlet and an outlet to the auxiliary heat exchanger are coupled to the refrigerant fluid circuit between the discharge port of the compressor and the switch over valve.

13. The side-discharge outdoor unit of claim 12, wherein the primary heat exchanger is an L-shaped heat exchanger.

14. The side-discharge outdoor unit of claim 12, wherein the auxiliary heat exchanger is arranged such that adjusting the direction of flow of the refrigerant by switching a position of the SOV does not reverse the flow of the refrigerant fluid of the refrigerant fluid circuit through the auxiliary heat exchanger.

15. The side-discharge outdoor unit of claim 12, wherein the auxiliary heat exchanger is a plate shaped auxiliary heat exchanger and includes a plurality of heat exchanger circuits, the plurality of heat exchanger circuits fluidly arranged in parallel.

16. The side-discharge unit of claim 12, further comprising a bypass circuit configured to selectively exclude the plate shaped auxiliary heat exchanger from the refrigerant fluid circuit.

17. The side-discharged unit of claim 16, further comprising a modulating valve configured to control the bypass line, the bypass valve configured to selectively exclude the plate shaped auxiliary heat exchanger from the refrigerant fluid circuit in heating mode.

18. The side-discharged unit of claim 12, wherein the second section may be generally perpendicular to each of the first section and the third section.

19. The side-discharge outdoor unit of claim 12, wherein the heat exchanger guard defines a height dimension of the side-discharge outdoor unit, the height dimension being a vertical length of the heat exchanger guard along a vertical axis of the side-discharge outdoor unit in an installed configuration, wherein the cover plate defines a width dimension and a depth dimension of the side-discharge outdoor unit, the width dimension being a first horizontal length of the cover plate along a first horizontal axis of the side-discharge outdoor unit in an installed configuration, the first horizontal axis being orthogonal to the vertical axis, and the depth dimension being a second horizontal length of the cover plate along a second horizontal axis of the side-discharge outdoor unit in an installed configuration, the second horizontal axis being orthogonal to both the vertical axis and the first horizontal axis, wherein the height dimension is greater than the width dimension, and the width dimension is greater than the depth dimension, wherein the outdoor fan includes a fan depth dimension, the fan depth dimension being an axial length of the outdoor fan along a central axis of the outdoor fan in an installed configuration, the central axis being normal to a plane defined by a circulation path of an impeller of the outdoor fan, wherein the depth dimension of the side-discharge outdoor unit is greater than the fan depth dimension by a given depth factor, the given depth factor being a value less than 2.

20. The side-discharge outdoor unit of claim 12, wherein the heat exchanger guard defines a height dimension of the side-discharge outdoor unit, the height dimension being a vertical length of the heat exchanger guard along a vertical axis of the side-discharge outdoor unit in an installed configuration, wherein the cover plate defines a width dimension and a depth dimension of the side-discharge outdoor unit, the width dimension being a first horizontal length of the cover plate along a first horizontal axis of the side-discharge outdoor unit in an installed configuration, the first horizontal axis being orthogonal to the vertical axis, and the depth dimension being a second horizontal length of the cover plate along a second horizontal axis of the side-discharge outdoor unit in an installed configuration, the second horizontal axis being orthogonal to both the vertical axis and the first horizontal axis, wherein the height dimension is greater than the width dimension, and the width dimension is greater than the depth dimension, wherein the outdoor fan includes a fan height dimension, the fan height dimension being a radial length of the outdoor fan along a plane defined by a circulation path of an impeller of the outdoor fan in an installed configuration, wherein the height dimension of the side-discharge outdoor unit is greater than the fan height dimension by a given height factor, the given height factor being a value less than 1.5.

* * * * *